US005193757A

United States Patent [19]

Talanker

[11] Patent Number: 5,193,757

[45] **Date of Patent: * Mar. 16, 1993**

[54] AUTOMATIC ROLLED CONVOLUTION ACCUMULATOR

[76] Inventor: Lev Talanker, 2940 West 5th Street, 22A, Brooklyn, N.Y. 11224-3832

[ * ] Notice: The portion of the term of this patent subsequent to Feb. 16, 2007 has been disclaimed.

[21] Appl. No.: 730,861

[22] Filed: May 6, 1985

[51] Int. Cl.[5] ..... B65H 45/02

[52] U.S. Cl. ..... 242/55

[58] Field of Search ..... 242/55, 55.19 R, 55.21, 242/78.1

[56] References Cited

U.S. PATENT DOCUMENTS

| | | | |
|---|---|---|---|
| 3,722,809 | 3/1973 | Leisring | 242/55 X |
| 3,860,188 | 1/1975 | Bradshaw | 242/78.1 |
| 4,497,452 | 2/1985 | Sendzimir | 242/78.1 |
| 4,529,140 | 7/1985 | Cooper et al. | 242/55 |

*Primary Examiner*—David Werner

[57] ABSTRACT

A method and device to store a moving strip of material in a continuous strip-feeding system adapted to variations of the feed-in speed in relation to rate of withdrawal, comprises forming a strip into a spiral coil having a constant number of turns and proceeding the strip in substantially the same angular direction with a spare space provided for convolutions to make variations of their mean diameter, and facilitating a change in the length of stored strip without direct forces applied perpendicular to a face of a single, or to a set of separated convolutions; and having the improvement in means to support and to run the strip along the convolutions involved, and comprises at the outer section a separate set of support rollers having at least two driven by a synchronized mechanical transmission from a torque generating unit, and also comprises at the inner section another set of rollers having at least two driven by another synchronized mechanical transmission.

1 Claim, 18 Drawing Sheets

FIG. 7a
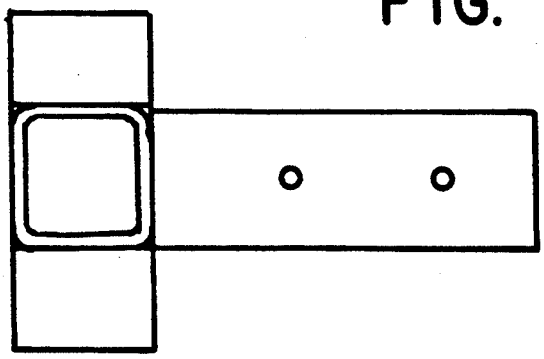
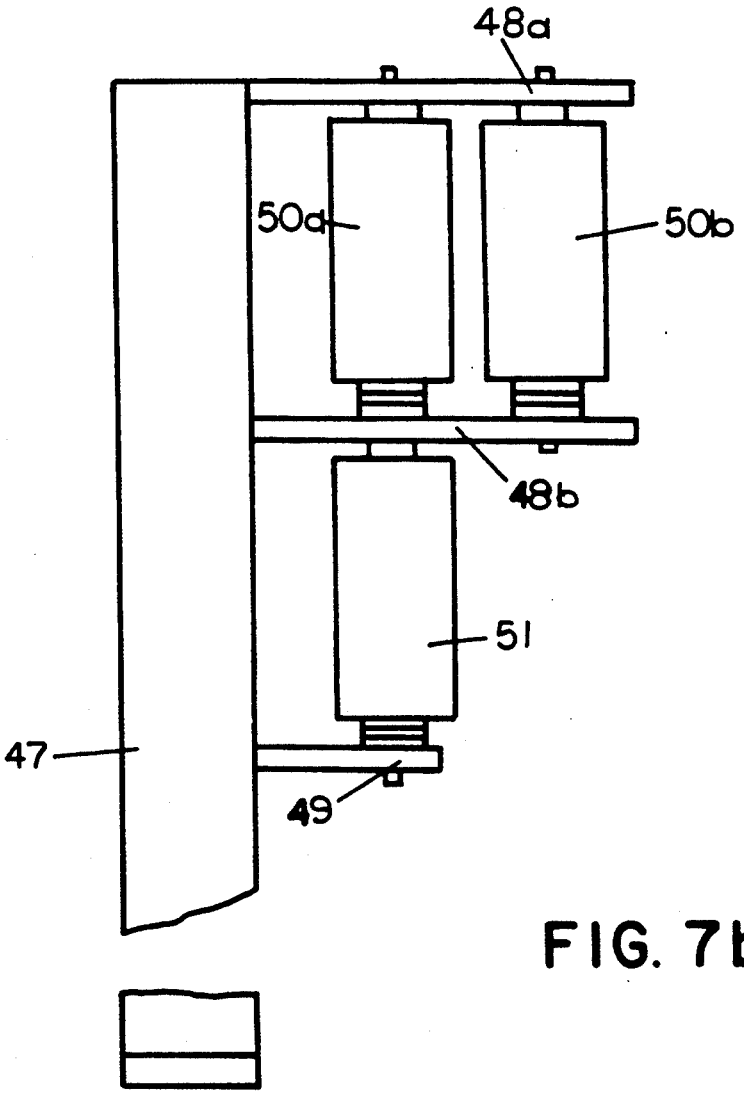
FIG. 7b

AUTOMATIC ROLLED CONVOLUTION ACCUMULATOR

BACKGROUND

The industries, feeding their process lines with continuous rolled materials, are looking for some accumulating device to obtain a continuous operation during downtime caused by the joining of the tail end of an old strip to the leading edge of a new strip. Some devices currently in use, bent the material strip around several horizontal axes, for example as it is disclosed in U.S. Pat. No. 4,086,689 of May 2, 1978. Other devices form spirals around a single vertical or a single horizontal axis. These kinds of device are attractive due to the comparatively small overall dimensions and by the ease of installation into existing plants.

The science on how to keep a moving strip in form of spiral coils to save the storage space has been gradually developed in a number of the U.S. patents. Good part of the said science belongs to the development of devices that can facilitate an uninterrupted motion of moving strip to use this kinematics for continuously working cinematographic apparatus. Among those patents are: U.S. Pat. No. 1,706,296 March 1929 by James; and U.S. Pat. No. 3,722,809 March 1973 by Leisring. The said devices can not be used in the process having a need for regular interruptions in the flow of incoming strip during ends-joining operations.

There is a number of moving strip storage devices keeping the said strip in form of spiral coils, and also providing an uninterrupted flow of outcoming strip during a process having regular interruption at incoming flow; having an internal loop of the stored strip with a flexible linear dimentions which allows to change the amount of length stored inside the said devices. Those devices are described in following units of Art: U.S. Pat. No. 2,318,316 May, 1943 by Lawrence; U.S. Pat. No. 3,310,255 March, 1967 by Sendzimir; U.S. Pat. No. 3,506,210 April, 1970 by La TOUR et al.; U.S. Pat. No. 3,628,742 December, 1971 by Fritzsche; U.S. Pat. No. 3,729,144 April, 1973 by Bijasiewicz et al.; U.S. Pat. No. 3,868,065 February, 1975 by Maruszczak; U.S. Pat. No. 4,092,007 May, 1978 by Weatherby et al.; U.S. Pat. No. 4,497,452 February, 1985 by Sendzimir. The said devices are good as long as they are applied to handle very flexible strip materials like telegraphic tapes, as it was first suggested by Lawrence in U.S. Pat. No. 2,318,316. In case of metal strip, the said devices are less attractive. The moving metal strip usually possess less flexibility than common telegraphic tape, so a permanent intercristal deformation could be developed inside the strip body during the motion along the machine loop due to the fact that the said loop has an opposite curvature regarding the curvature within incoming part of the strip storage space involved. Here a metal strip is bent inside the loop in the opposite direction, what is undesirable. For the device itself a change in direction of curvature of moving strip needs a heavy and a complicated construction capable to cope with great inertia of quickly moving metal strip. For heavy gauge materials the inertia and lack of elasticity may never allow to build the said king of device within some reasonable overall dimentions. The other way to handle a metal strip materials must be searched.

There is a number of devices to keep a quickly moving strip with uninterrupted outcoming flow, while incoming flow may have some interruptions, and also utilizing only one directional curvature within the space of the device involved. Those devices are developed in the following patents: U.S. Pat. No. 617,432 January, 1899 by Casler; U.S. Pat. No. 2,032,336 February, 1936 by Strauss; U.S. Pat. No. 3,258,212 June, 1966 by La TOUR; U.S. Pat. No. 3,341,139 September, 1967 by La TOUR; U.S. Pat. No. 3,860,188 January, 1975 by Bradshaw; U.S. Pat. No. 3,999,718 December, 1976 by Ziemba; U.S. Pat. No. 4,012,004 March, 1977 by Tonellato; U.S. Pat. No. 4,410,121 October, 1983 by Wheeler et al.; U.S. Pat. No. 4,456,189 June, 1984 by Wheeler et al.; U.S. Pat. No. 4,473,193 September, 1984 by Cooper et al.; U.S. Pat. No. 4,529,140 June, 1985 by Cooper. The devices by Casler—U.S. Pat. No. 617,432; Strauss—U.S. Pat. No. 3,258,212 and Tonellato U.S. Pat. No. 4,012,004 are mainly intended to handle some light materials coiled around horizontally oriented axis. They do not provide any parts or assemblies to separate the stored spiral convolutions one from another, so a lot of friction forces must be anticipated between the adjacent material convolutions, especially as soon as heavy gauge material going to be processed by those devices. Those devices can not be considered for future application to process a heavy and/or quickly moving metal strip.

The devices by Wheeler et al—U.S. Pat. Nos. 4,410,121 and 4,456,189; and by Cooper, U.S. Pat. No. 4,529,140 et al are utilising some special parts and assemblies to change the main diameter of stored, however, being moved material strip. All those devices do apply a direct force perpendicular to faces of processed coils that should be maintained by a precise synchronization between the parts involved in a common reciprocating motion perpendicular to the faces of stored coils, and the parts involved to control the speed of coiled spiral within the accumulator. The needed synchronization is hard, if only not impossible, to achieve by affordable technical means.

Five additional devices are shown in U.S. Pat. Nos. 3,258,212; 3,341,139; 3,860,188; 3,999,718; 4,410,121. The first three devices take incoming flow of strip at outermost convolution having the outcoming flow in area of innermost convolution. Two last devices are handling the processed material in an opposite direction.

In the preferred device the processed strip is moved inside the accumulator through a set of vertical rolls in the form of a downward helix. At the bottom, the material is transferred around the inner diameter of the storage section of the machine, then through a sequence of several continuous spirals around the machine's vertical center line—towards outermost diameter of the spiral, and, finally, out to feed a mill process line. During the jointing of strip ends the flow of input material is interrupted, but it is essential to maintain continuous feed of outermost spiral convolution that goes into the mill process line without any interruption. While the strip in the machine input line is held to allow the ends-joining operation, the innermost spiral contracts down the inner vertical rolls to the maximum extent. This contraction lasts as long as the outermost spirals are supplied into the mill process line. Only material strip disruption such as in the feed to join another strip, or a machine breakdown, or a control signal engagement may stop this process; Then, controlled by a special signal, the accumulator is gradually filled in to the capacity, as all available spirals must be expanded to the maximum toward the outermost diameter.

Shrinking and rolling out of the spirals are supported by a set of horizontal radially-elongated rolls having a constant rotating surface speed along the machine diameter. The velocities of the mating surfaces of the spirals, however, are not constant. The poor match of the mating velocities generates abnormal friction leading to a greate consumption of energy, frequent maintenance, an excessive need for replacement parts, poor operation, and damages to the processed material.

Nevertheless, the machines utilizing heavy gauge materials do perform their functions, whereas with light gauge materials they tend to malfunction. Here then, we see the second problem of moving materials along the root of continuous spirals. A proper control of the input and the output material speed is not enough to ensure proper operation, while the speed of material expansion from the inner diameter zone into the outer diameter zone also needs to be controlled. With heavy gauge materials expansion speed may be sufficiently controlled by the elastic deformation forces directed toward the spiral tendency to expand it's curvature line. With light gauge materials the elastic deformation forces must be negligible, if even measurable, so the said forces can not ensure a dependable expansion speed. Thus, irregular waves have been observed along the curvature of light gauge material spirals.

The waves generate conditions which damage the spiral surfaces, that is absolutely unacceptable for coated and plated materials. On the other hand, excessive expansion forces may also cause the same kind of damages, due to lack of clearances between adjacent spirals, what is also unacceptable in these processes.

It is important to notice that the kinematic relationship between mating surfaces of the moving spirals and the supporting rolls should influence the spirals to expand, providing the rolls transfer some torque to the spiral. Otherwise, this relationship should influence the spiral to make waves, especially if the rolls take some rotating torque from them. Depending on the material thickness and the elastic deformation involved, the direction and amount of mechanical influence needed to be transferred from the supporting rolls to the spirals, if any, may vary. The existing coil accumulators do not provide any effectively controlled flexibility in kinemetic relationship between the two mating surfaces under consideration, that means they are suitable only for a small group of materials. As long as the said group of materials is smaller than the group of materials that can go through the strip ends-joining equipment, and then through the mill process line, one should expect such machines to be dismissed from a customer's consideration.

A further weak point of the existing machines concerns operating difficulties in setting up proper timing for all the power driven motors to synchronize the machine modes with the cycles of the adjoining material processing line equipment. It is clear that as long as an operator's attention needs to be engaged in controlling the machine, any benefits from machine utilization are undermined.

It is an objective of the invention disclosed herein to provide an improved machine by reducing all the above listed disadvantages down to an acceptable level; and to generate an increased customer demand for the said machine.

SUMMARY

According to the invention the following new features facilitate the improvements of the devices disclosed in the U.S. Pat. Nos. 3,506,210; 3,860,188; 4,473,193:

a) The rolled strip motion inside the accumulator is engaged by four independent power stations, comprising electrical motors and transmissions in each station to transfer a rotary torque to: 1) Input Pinch Roll 2) Pinch Roll 3) Inner Support Roll Assembly 4) Outer Support Roll Assembly Note that, generally, more than one inner and more than one outer support roll assembly may be applied.

b) The timing and speed of each power station are independently controlled by either automatic or manual operations, providing the ability to influence the strip sprials' spacing, and to choose the best working conditions, thus minimizing friction forces between mating surfaces.

c) The inside support roll assembly is located under the inner part of the strip spirals, those involved in contracting motions during welding cycles. The outside support roll assembly is located under the outer part of the strip spirals, which are continuously involved in a motion toward the accumulator's output pinch roll, so that neither of the said spirals will contract. Sufficient space is provided on top of the outside support rolls to carry a larger quantity of spirals during the cycle, operating with synchronized input and output speeds of the rolled material.

d) A two-line mechanical transmission drives the outer support rolls independently from inner support rolls, thus facilitating a feature to keep independent rotary speeds on each of the two lines, and on each of the two sheared parts of any support roll.

e) Support rolls of both assemblies have working surfaces in two parts, and each is driven from the mounting sides of vertical stands by sprocket and chain arrangements, with an independently preset and easily corrected rotary relationship to the mechanical transmission shaft. This provides an option to get the best mating velocities of the roll surfaces with roll material spirals to reach an acceptable spacing at minimum electrical consumption.

f) A synchronized interface is proveded towards adjacent parts of an automated line, facilitating an option for operation without an operator.

g) A set of visual indicators and a memory device are installed to provide the conditions for quick and optimal setting of the timers, and acceleration-deceleration devices to achieve the best energy conservation with minimum readjustment time for different kinds of rolled material.

If the strip flow goes in an opposite direction winthin another possible embodiment, the names of inner and outer support rolls must be changed in accordance to the functions anticipanted for each of them within the different embodiment. The positions and names of some other parts and assemblies involved needs to be adjusted.

The embodiment having the strip convolutions axis located at some angle regarding vertical line from 0° to 90° are thought possible. The imbodiments without any automatic features are also thought possible.

BRIEF DESCRIPTION OF DRAWINGS

FIGS. 7*a* and 7*b* shown the inner vertical roll arrangement.

FIGS. 13*a*, 13*b* and 13*c* show, respectively, a top, a front, and a sectional view of the output pinch roll assembly. Front elevation has a cross-section through the gear box.

DETAILED DESCRIPTION OF THE PREFERRED EMBODIMENT

Figure 1:
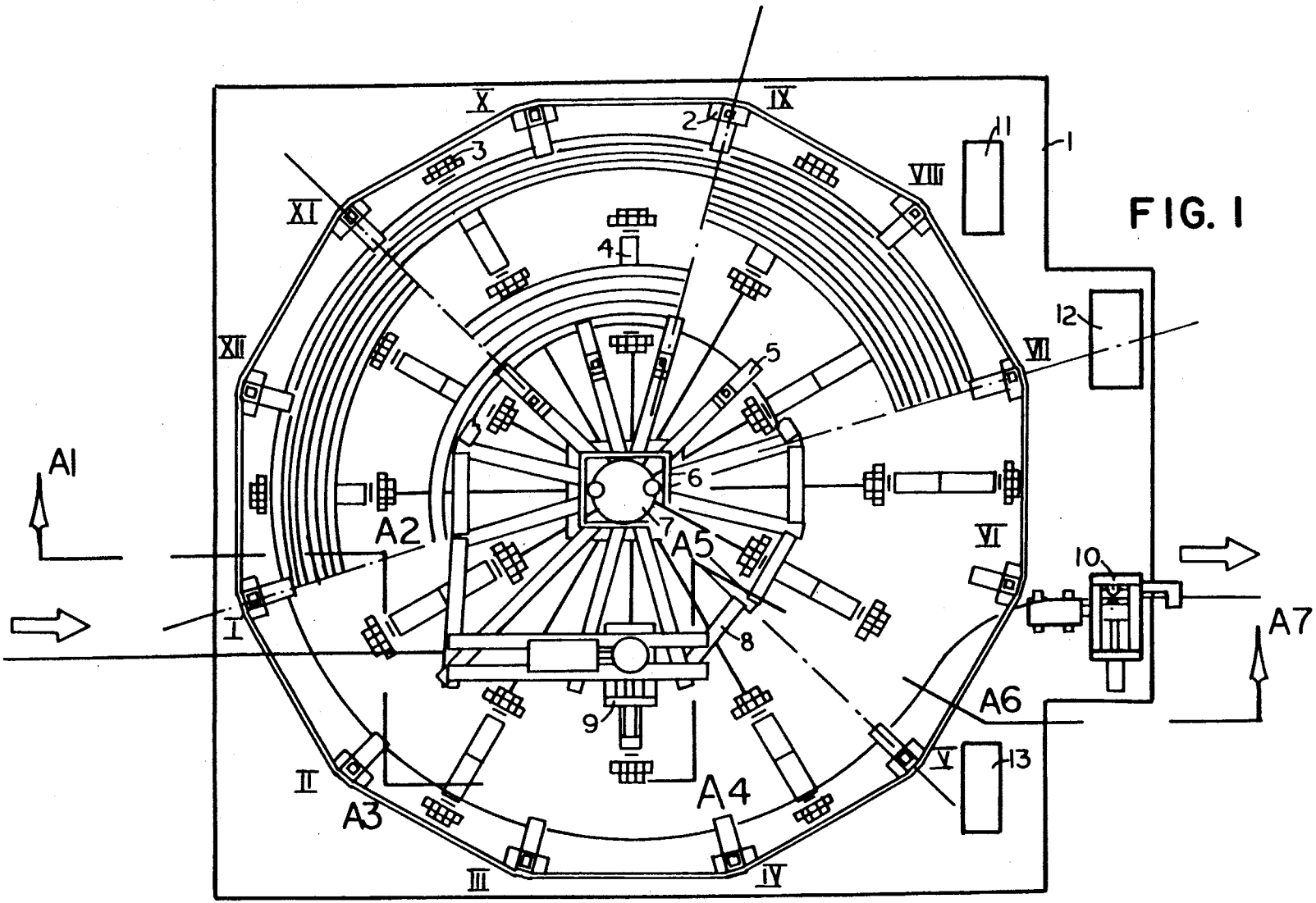
FIG. 1—is a top view of the machine. An outer part of the top frame (FIG. 11) between sections VII through XII is removed to show inner vertical roll assembly. "Filled-in" load of the material spirals is shown in sections VII-VIII-IX. An "empty" load of spiral is shown in sections IX-X-XI. A discharge and a fill-in cycle's load are shown in sections XI-XII-I. The last discharging spiral is shown in sections I-II-III-VI.
Figure 2:
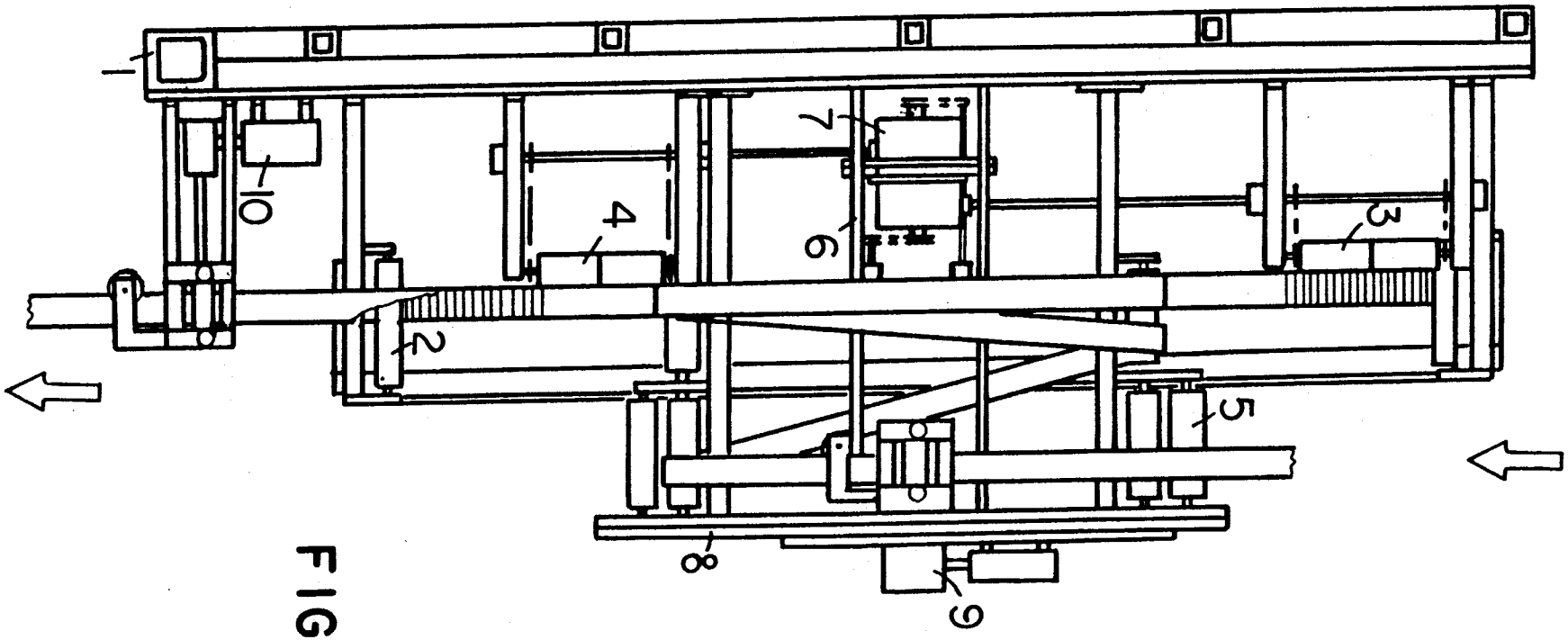
FIG. 2—is a front elevation, the sectional view taken by a kneeled line A1-A2-A3-A4-A5-A6-A7 shown of FIG. 1.

General arrangement of the automatic rolled convolution accumulator consists of Base 1 (See FIGS. 1 and 2), Outer Vertical Roll Assembly 2, Outer Support Roll Assembly 3, Inner Support Roll Assembly 4, Inner Verical Roll Assembly 5, Central Power Tower 6, Mechanical Transmission 7, Top Frame 8, Input Pinch Roll Assembly 9, Outer Pinch Roll Assembly 10, Hydraulic Power System 11, Electrical Power System 12, and Control Panel 13. All 13 major components are welded and bolted in places as shown in FIGS. 1 and 2. Electrical motors, sensors and controls are interfaced by electrical cables and wires.

Figure 3A:
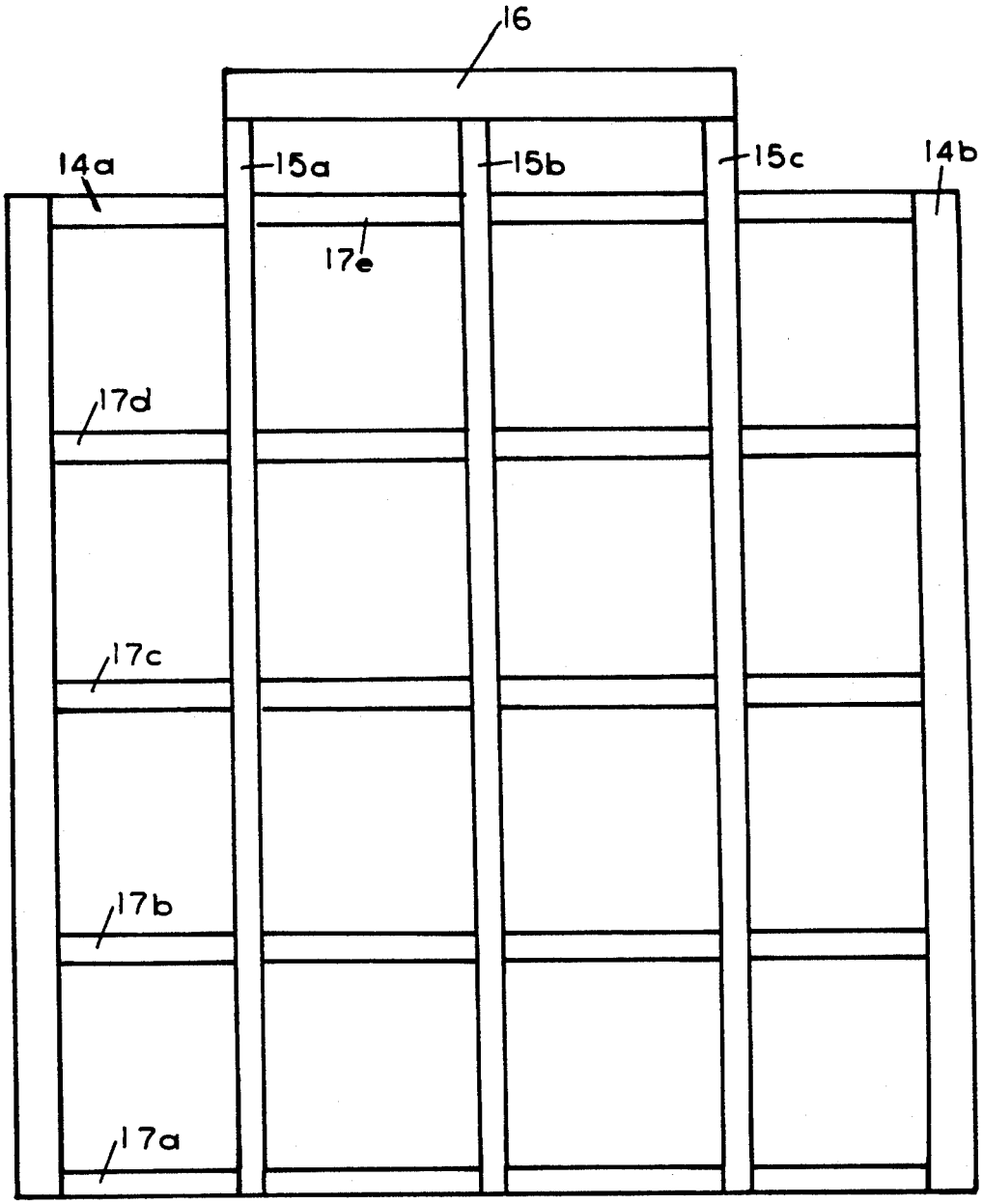
FIG. 3*a*—is a bottom and FIG. 3*b* is a left side view of the machine base.
Figure 3B:
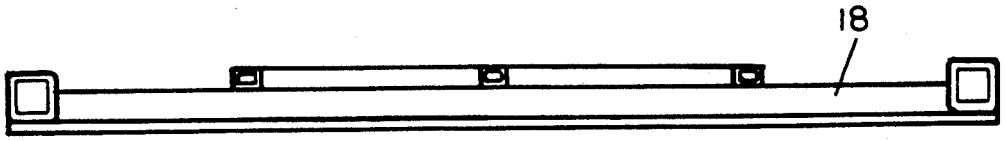

Base (FIG. 3) consist of two short longitudinal elements 14*a* and 14*b*, three long longitudinal elements 15*a*, 15*b* and 15*c*, a short traverse element 16, and five long treverse elements 17*a*, 17*b*, 17*c*, 17*d*, 17*e*, and a plate 18. All parts 13 through 18 are joined by welding or bolting.

Figure 4A:
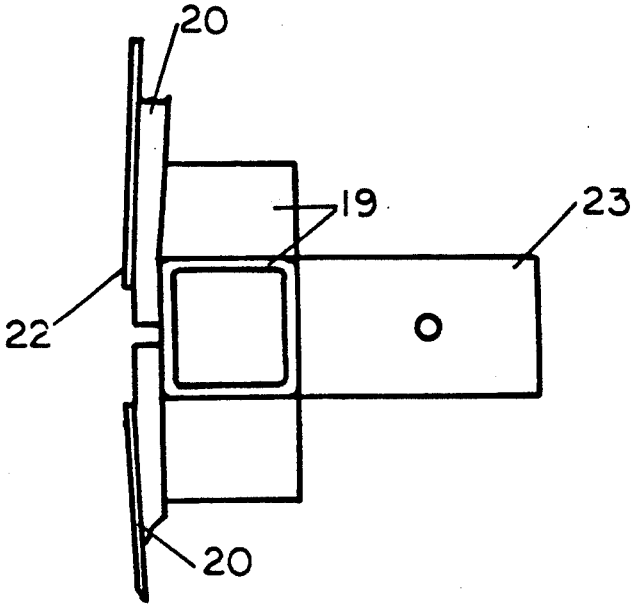
FIGS. 4*a* and 4*b* show top and side views, respectively, of the outer vertical roll assembly.
Figure 4B:
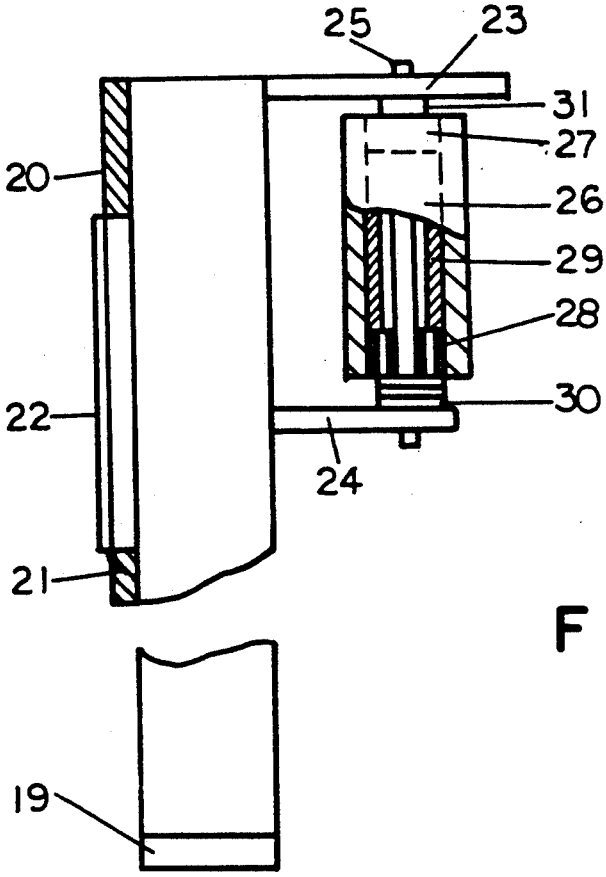

Outer vertical roll assembly (FIG. 4) consists of a set of 12 vertical poles 19 numbered in Arabic on FIG. 1., and having footplates bolted to the base along a circle of the outer diameter of the machine. All twelve poles 19 are interconnected by horizontal members 20 and 21, bearing safety panels 22 in order to prevent inadvertent human contact with the running strip. Each pole bears two welded horizontal plates 23 and 24 with drills to fix a roll axis 25. Vertical roll 26 has round tubing body mounted on two bearings 27 and 28. They are separated by a round tubing spacer 29. Thrust bearing 30 and thrust washer 31 separates vertical roll from horizontal plates 23 and 24. Outer support roll assembly consists of six equally-space horizontal rolls; however, any other number of horizontal rolls in excess of two: e.g., 3, 4, 5, . . . , may be accepted in the machine under consideration, providing the machine's internal space and the rolled material elasticity conforms reliability of machine operation. Each roll is supported by two stands 32 and 33 having two vertical members 32*a* and 32*b* (See FIG. 5 and 6). Both vertical members are welded to a foot 34, and to a horizontal bar 35, and to a transmission bracket 36. An axis pillow 37 is bolted to each bar 35, and axle 38 is fixed to each pillow by a screw 39.

Figure 5:
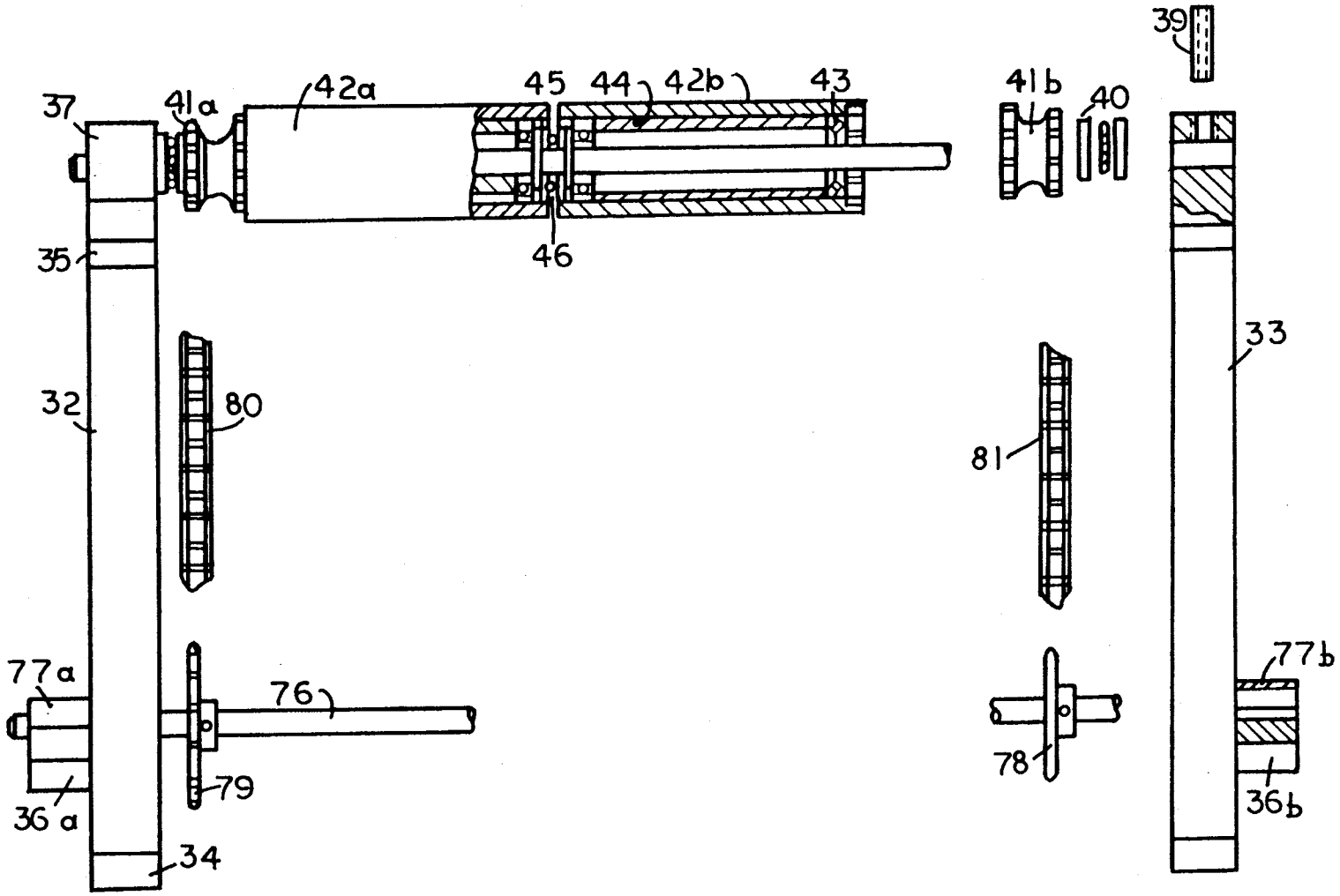
FIG. 5—shows support roll assembly. Sectional cutouts and blown-up view on right side parts are provided to illustrate the mounting order. Sprockets and two-chained transmission is shown as well.
Figure 6A:
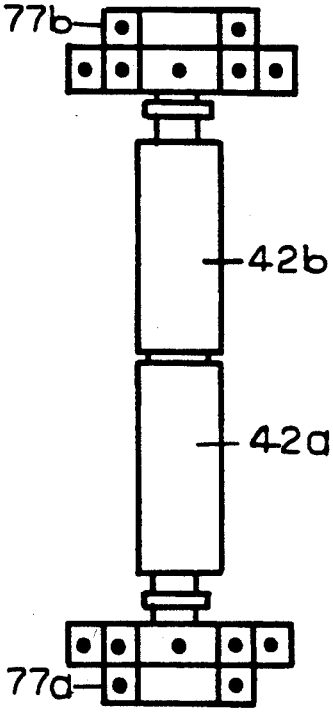
FIGS. 6*a* and 6*b* show top and side views, respectively of the support roll as shown on FIG. 5.
Figure 6B:
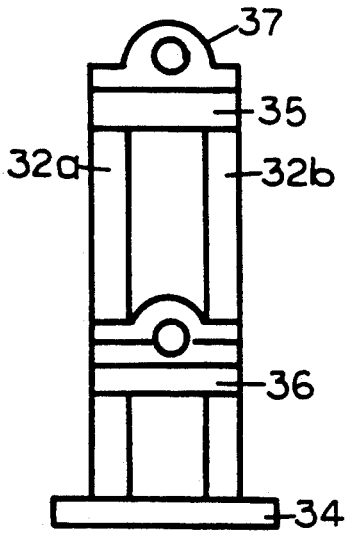

On each side of axis 38 are mounted three members of a thrust bearing 40, a special sprocket 41 having two lines of teeth: one joined with a press fit into the roll body 42*b*, and the second to be meshed with a transmission chain 81. The special sprocket on FIG. 5 is called 41*a* on the left side, and 41*b* on the right side. The largest diameter of the special sprocket teeth for the transmission chain must be less than the face diameter of the roll body 42*a*=42*b*. The top elevation of the pillows 37 must be located below the top elevation of the roll bodies 42*a* and 42*b* in order to make clearance for a strip spiral expansion motion from inner support roll zone.

A tapered rolled bearing 43, a spacer tube 44, and an antifriction bearing 45 are mounted before the special sprocket is put on. One thrust bearing 46 is mounted on axle 38 from any side as the first item from the chosen side. Where necessary, the roll may have an unsheared body without a thrust bearing 46.

Inner support roll assembly is built identically to outer support roll assembly, but the location of the roll stands must be different in accordance with the FIG. 1 and 2. Some geometrical dimensions may be different, however; the description for the outer support roll assembly should be also valid for inner support roll assembly.

Inner vertical roll assembly consists of twelve poles 47 (FIG. 7). Each pole has two identical mounting plates 48*a* and 48*b*, and one short mounting plate 49. The mounting plates serves to fix the axis of the top, idling vertical rolls 50*a* and 50*b*, and to fix the axis of the lower vertical roll 51. Rolls are rotary-fixed in the same way as in the outer vertical roll assembly, see FIG. 4.

Figure 8:
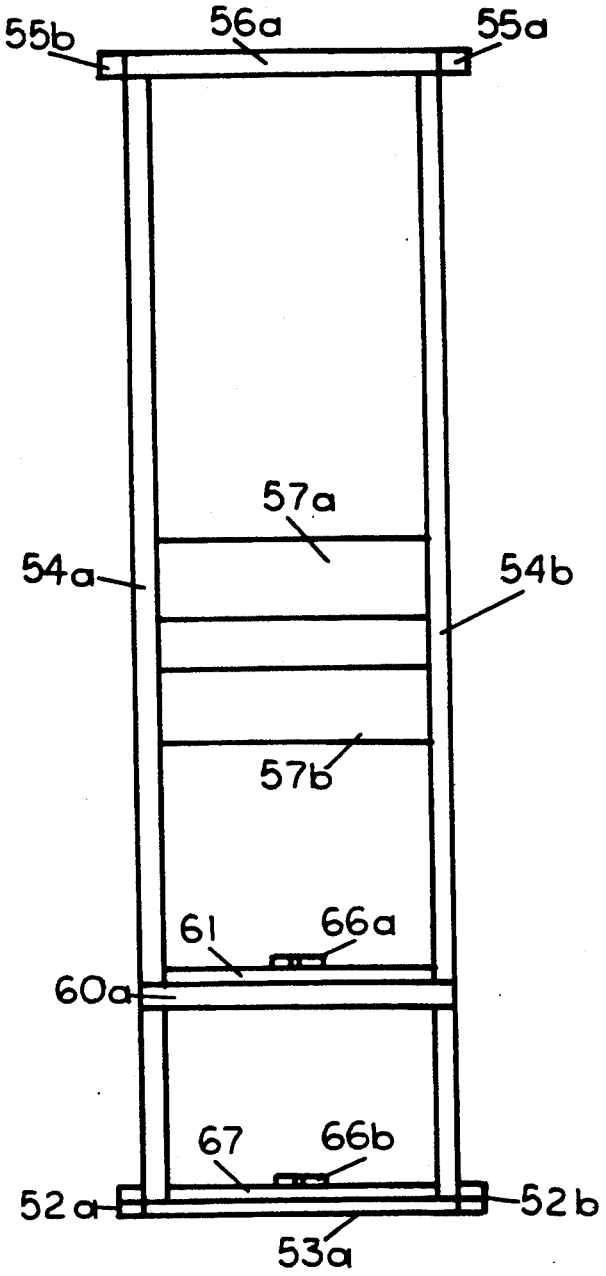
FIG. 8—is a left side view on the central power tower. This is a view from the direction of input strip flow.
Figure 9A:
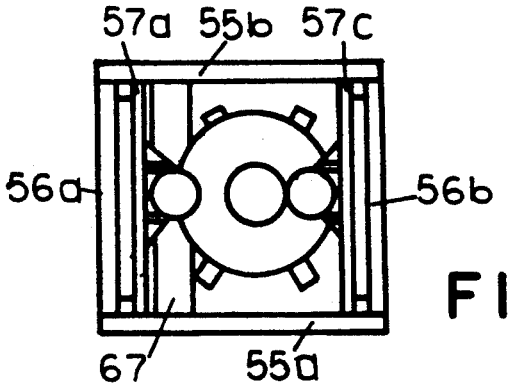
FIG. 9—shows three views of central power tower having installed two DC motors and two special gear boxes.
Figure 9B:
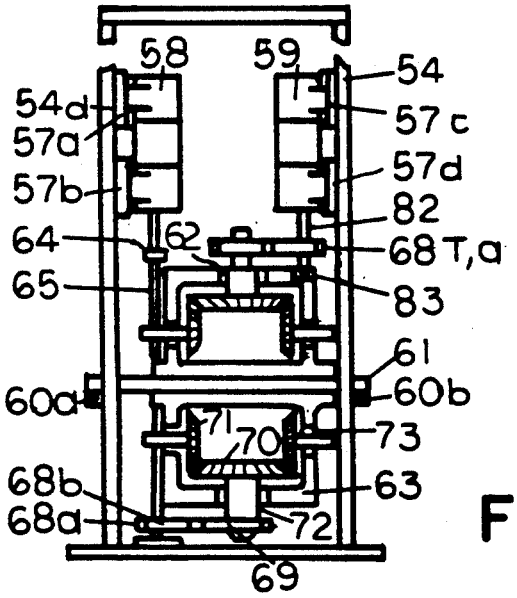
Figure 9C:
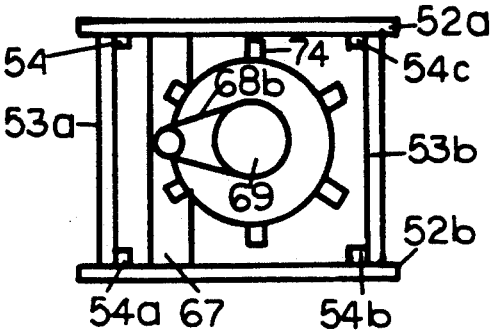

Central power tower (See FIG. 8 and FIG. 9) consists of a rectangular base having two long members 52*a* and 52*b*, and two short members 53*a* and 53*b*. The tower has four vertical members 54*a*, 54*b*, 54*c*, and 54*d*. The top part has two long horizontal members 55*a*, and 55*b*, and two short horizontal members 56*a*, and 56*b*. Four other horizontal members 57*a*, 57*b*, 57*c*, and 57*d* serve to fix the power motors 58 and 59. The other two horizontal members 60*a* and 60*b* are of the same length as the members 53*a* and 53*b*. Members 60*a* and 60*b* support the platform 61, and this platform serves as a base to fix the top gear box 62, and the lower gear box 63. The plate 61 has a bearing 66*a* installed to support the long vertical shaft of mechanical transmission. The next horizontal plate 67 provides the other support for the said shaft with the other bearing 66*b*. The four vertical members 54*a*, 54*b*, 54*c*, and 54*d* are extended to allow the top horizontal members of central power tower to be joined with the top plate 9 (FIG. 1).

Mechanical transmission consists of four lines:

a) The line from the input pinch roll DC motor to the pinch roll driven axle;

b) The line from the output pinch roll DC motor to the pinch roll driven axle;

c) The line from the inner support roll DC motor to the corresponding special sprockets of the rolls;

d) The same as in item (c) for outer support roll assembly.

The two lines (a) and (b) are described as parts of the input and output roll assemblies. The other two lines (c) and (d) are described below as a unit of the machine, but considered to be a separate assembly.

Figure 10:
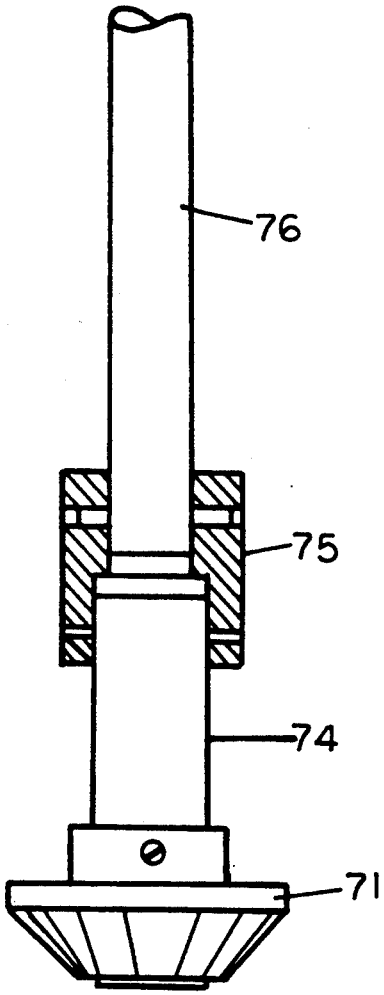
FIG. 10—illustrates a coupling between a small level gear wheel shaft and a mechanical transmission shaft.

The driving torque from motor 58 through coupling 64, and through long vertical shaft 65, mounted on bearings 66*a* and 66*b*, goes on pulley 68*a*, on timing belt 68*b*, the gear box pulley 69, which is fixed mounted on the same axle with the large bevel gear wheel 70. Gear wheel 70 meshes six equally spaced small bevel gears 71. The gear 70 is mounted in the gear case 63 by the bearing sleeve 72, that allows to transfer a rotary torque to all small bevel gears 71. Each gear 71 is in turn, rotary mounted into the same case by the bearing sleeve 73, and shaft 74, shown on FIG. 10.

Each small bevel gear 71 is gear 71 is fixed to a shaft 74 (See FIG. 10), and is also joined through this shaft and a coupling 75 with a transmission shaft 76. Each shaft 76 is supported by two bearings 77*a* and 77*b* (See FIG. 5), and the bearings are bolted to brackets 36*a* and 36*b* of inner support roll stands as is shown on FIG. 5 and 6. Sprocket wheels 78 and 79 are joined to the shaft 76, and both sprocket wheels through two chains 80 and 81 are engaged to move the sprockets 41*a* and 41*b* together with bodies 42*a* and 42*b* of the inner support roll involved.

Working diameters of sprocket wheels 79 and 78, together with working length of chains 80 and 81, can be chosen to facilitate the best material spirals handling inside the machine. In a special case, they may be equal to each other, and used in an assembly with an unsheared support roll body. This special case may be necessary to handle light gauge rolled material having its thickness at or about the minimum clearance needed between two sheared parts of the support rolls in use, providing the material elastic deformation is big enough to ensure the spirals expansion toward the outer diameter circle without waves or loops.

The electrical motor 59 (FIG. 9.) drives the outer support rolls. The motor transfers its torque by a short vertical shaft 82, rotary mounted on bearing 83, which is joined to the top gear box case 62. The pulley 68*a*T is identical to the pulley 68*a*. All functions and kinematic arrangements of other details involved in transferring the torque from pulley 68*a*T to the outer support roll bodies, are identical, providing some differences in geometric dimensions are neglected.

Figure 11A:
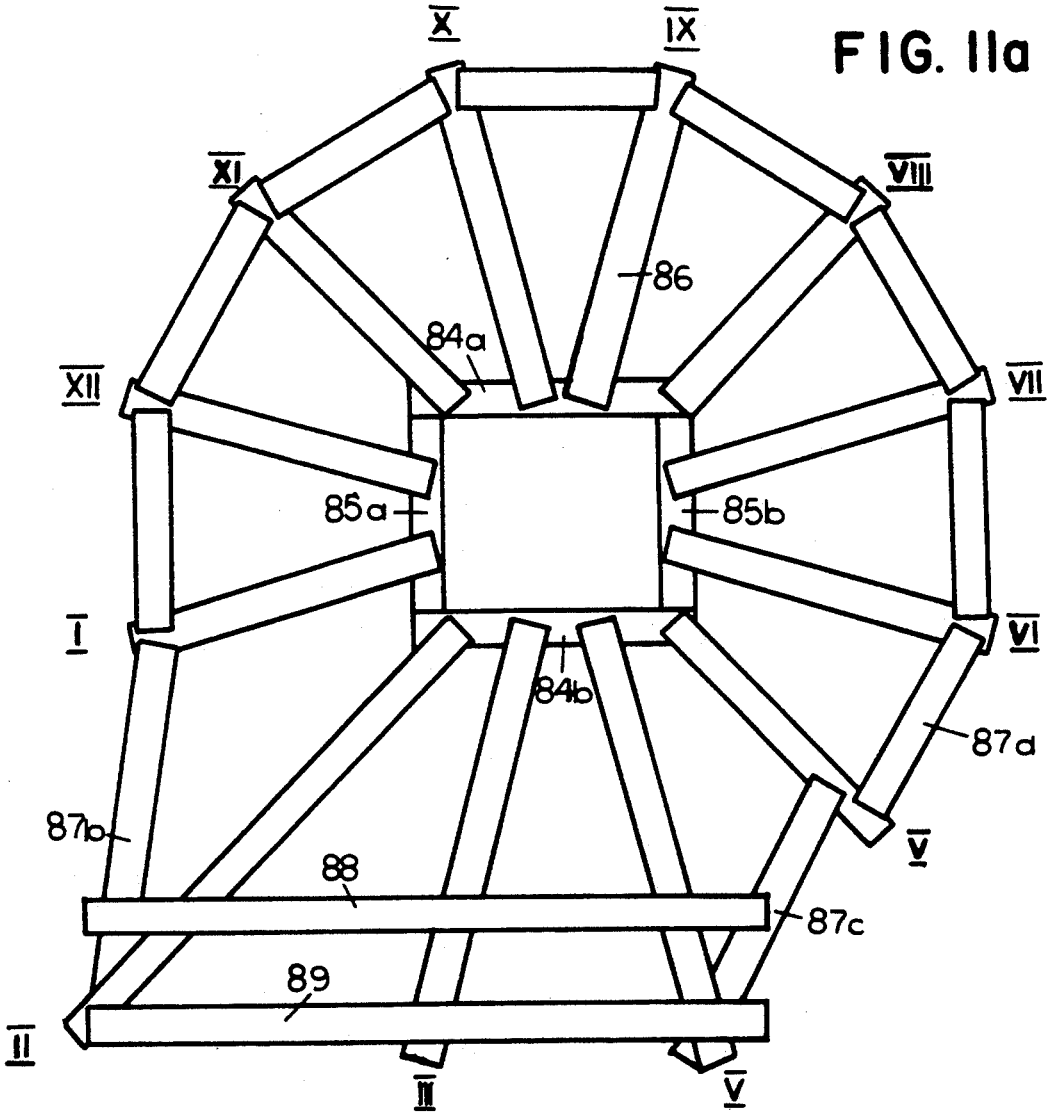
FIGS. 11*a* and 11*b* show top and front views, respectively, of the top frame.
Figure 11B:
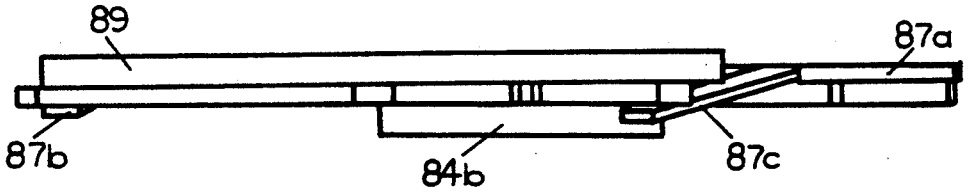

Top frame has a central frame from two long members 84*a* and 84*b* (See FIG. 11), and two short members 85*a* and 85*b*. Dimensions of the members 85 and 84 must allow the top frame of central power tower (items 55*a*, 55*b*, 56*a* and 56*b* on FIG. 9) to fit in the central frame of top frame shown on FIG. 11. Both frames must be bolted or welded together. The central frame is joined to 12 radially-elongated members 86 (I through XII) of varying lengths, to permit them to reach and to be joined to twelve corresponding members 47 and 48*a* of inner vertical roll assembly shown on FIG. 7.

Members I–XII; XII–XI; XI–X; X–IX; IX–VIII; VIII–VII and VI–V are connected by eight pieces 87*a* of equivalent length.

Members I–II are connected by one piece 87*b* of unique length, and members V–IV are connected by the other unique piece 87*c*. Front ends of members 87*b* and 87*c* are connected to the bottom sides of 86-IV, 86-III and 86-IV correspondingly on the top sides of members 86-II, 86-III, and 86-IV are welded two paralled barrs 88 and 89, both serving to hold the input pinch roll assembly.

Figure 12A:
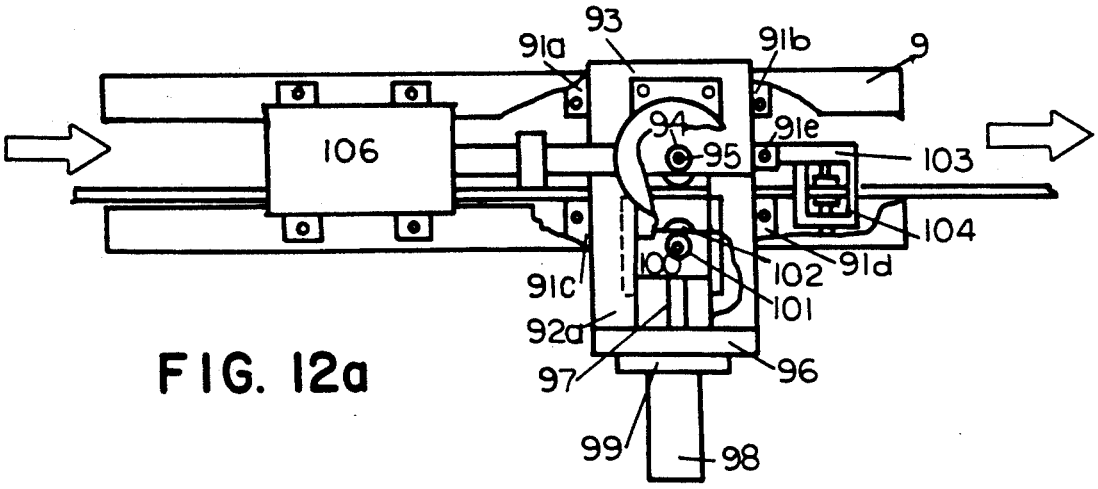
FIGS. 12*a* and 12*b* illustrate, respectively, a top and a front view of the input pinch roll assembly. Two members of top frame have cross-sections to show the four mounting brackets, and some parts of the vertical transmission. The angle gear box has a cross-section of the top, and a vertical cross-section of the front elevation. A right side member 92*b* has a cross-section of the top to show the slot for the slider cam.
Figure 12B:
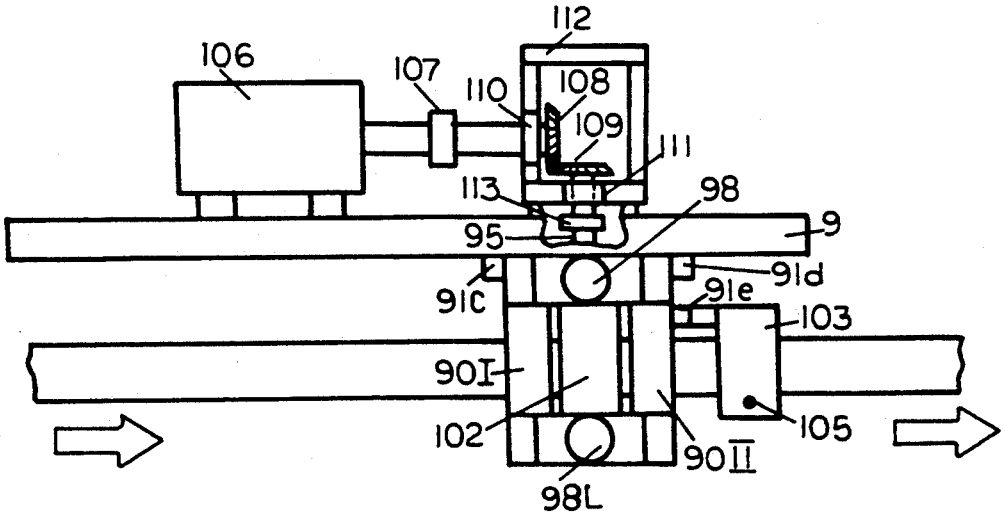

Input pinch roll assembly consists of two rectangular frames welded to each other in the form of a box having four vertical tubes, two of which are shown on FIG. 12, numbers 90-I and 90-II. The top rectangular frame has four welded brackets 91*a*, 91*b*, 91*c*, 91*d* to bolt the assembly on top of frame 9. An additional bracket 91*e* has a vertical hole to be used for a pivot axle to hang strip-supporting case. The top rectangular frame has two long members 92*a* and 92*b*, a short member 93 with a bearing 94 to hold an axle 95 of driving pinch roll, and one more short member 96 having in the center a ream for a rod 97 of hydraulic cylinder 98, and several threaded drills to bolt a hydraulic cylinder mounting plate 99. Members 92*a* and 92*b* are slotted from inner sides to accept sliding cams of a slider 100. The slider has a ream to fix an axle of idling roll 101. An idling roll 102 is fixed between two sliders in the way shown on FIG. 4 for a body of vertical rolls. Each slider is fixed to the hydraulic cylinder rod 97, and it can be moved back and forth in horizontal direction, to and from the rolled material strip. Two sliders are welded together by a vertical tubing 102, that provides simultaneous reciprocating motions generated by two hydraulic cylinders 98 and 98L.

A bent frame 103, having a "V" reamed idling wheel 104, is rotary fixed on an axle 105, and serves to support the bottom edge of the processed rolled material.

A DC motor 106 through a coupling 107 rotates two meshed bevel gears 108 and 109, and both are rotary fixed by bearing sleeves 110 and 111 inside a gear case 112. The gear wheel 109 through its axle, and through a coupling 113 transmits the torque generated by the electrical motor 106 directly to the driving roll axle 95.

Output pinch roll assembly also consists of two rectangular frames welded to each other by vertical tubes 90D-I and 90D-II from the front (See FIG. 13), and by another two vertical tubes in a similar position from the back. The top frame has a welded bracket 91D with a vertical hole to be used for a pivot axle to hang on a strip supporting case. The top rectangular frame has two long members 92D*a* and 92D*b*, a short member 93D, a short member 93D with a bearing 94D to hold an axle 95D of driving pinch roll, and one more short member 96D having a center ream for a rod 97D of hydraulic cylinder mounting plate 99D. Members of both frames 92D*a* and 92D*b* are slotted from inner sides to keep sliding cams of slider 100D. The slider has a ream to fix an axle of idling roll 101D. An idling roll 102D is fixed between two sliders in the way shown on FIG. 4 for a body of a vertical roll. Each slider is fixed to the hydraulic cylinder rod 97D, and it can be moved back and forth in a horizontal direction, to and from the rolled material strip. Two sliders are welded together by vertical tubing 102D, thus allow only simultaneous reciprocating motions, generated by two hydraulic cylinders 98D and 98T.

A bent frame 103D, having a "V" reamed idling wheel 104D, is rotary fixed on an axle 105D, and serves to support the bottom edge of the processed rolled material.

A DC motor 114 through a coupling 107D rotates two meshed bevel gears 108D and 109D; both bevel gears are rotary fixed by bearing sleeves 110D and 111D inside a gear case 112D. The gear wheel 109D through its axle, and through a coupling 113D transmits the torque generated by the electrical motor 114 directly to the driving roll axle 95D.

Figure 13A:
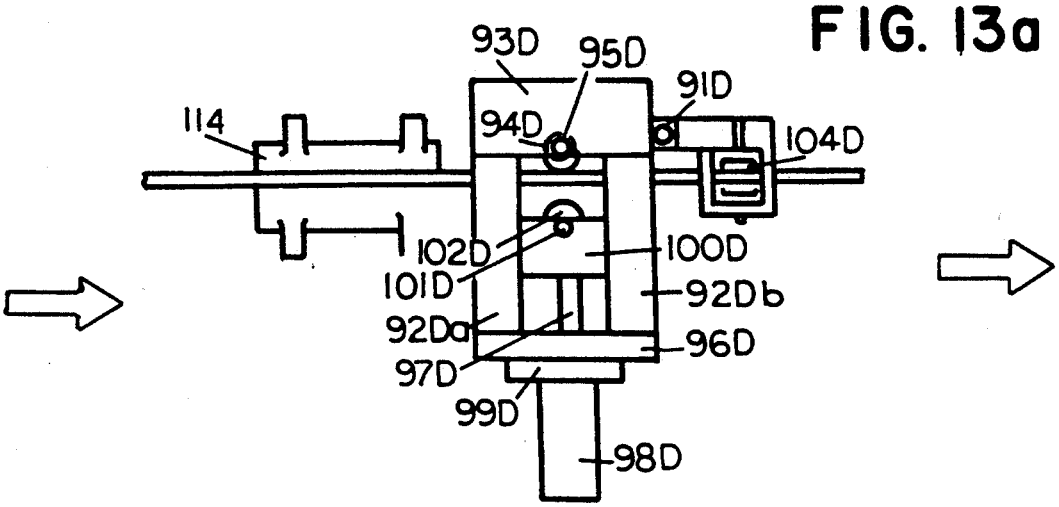
Figure 13B:
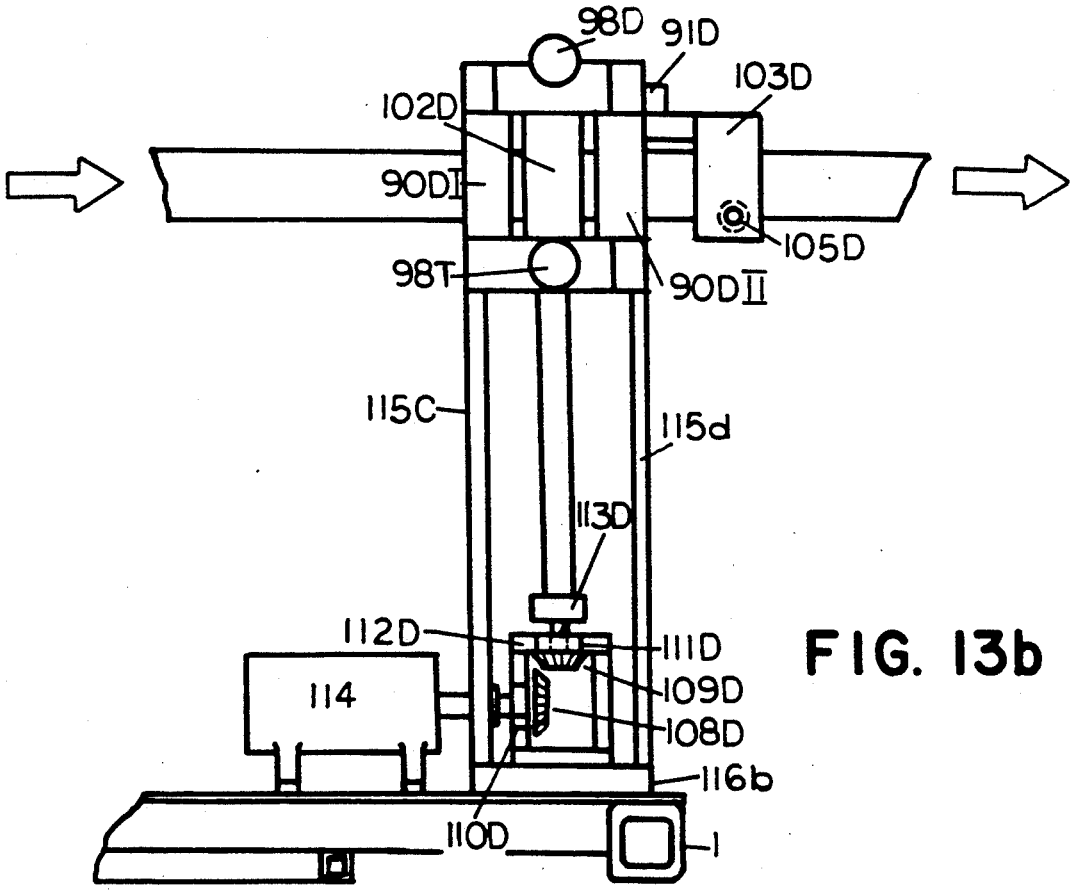

As shown in FIG. 13, the pinch roll frames are supported by four vertical tubes 115*a*, 115*b*, 115*c*, and 115*d*. Two short footplates 116*a* and 116*b*, and two long footplates 117*a* and 117*b* are welded with the vertical tubes. The footplates are provided with holes for bolting and for welding to the machine base 1. (See FIG. 1, 2).

HYDRAULIC POWER SYSTEM consists of a hydraulic tank 118, a hydraulic pump with an electrical drive 119, an strainer 120, a controlled pressure valve 121 having manual and electrical adjustments together with a sensor to monitor the system's hydraulic pressure from the control panel 13 (FIG. 1.). A hydraulic accumulator 122 is the last item serving for both lines of input and output pinch rolls. A "close-open" hydraulic valve 123, having manual and electrical controls, serves for input pinch roll engagement. The same kind of valve 124 is utlized to control output pinch roll engagement. Solenoids 125 and 126 are synchronized, and they serve to switch the manual control for electrical one, and vise versa.

Two cylinders 98 and 98L are installed into input pinch roll assembly, and two cylinders 98T and 98D are installed into output pinch roll assembly. All the cylinders are one-side-actuated having a spring return. Parts 118 through 126 are fixed on plate 11, FIG. 1 Terminals 127–132 are utilized to interface with control panel 13, FIG. 1. Valves 123 and 124 may be located at corresponding pinch roll assemblies to ease manual engagements of pinch roll pressure on a processed material strip.

Figure 15:
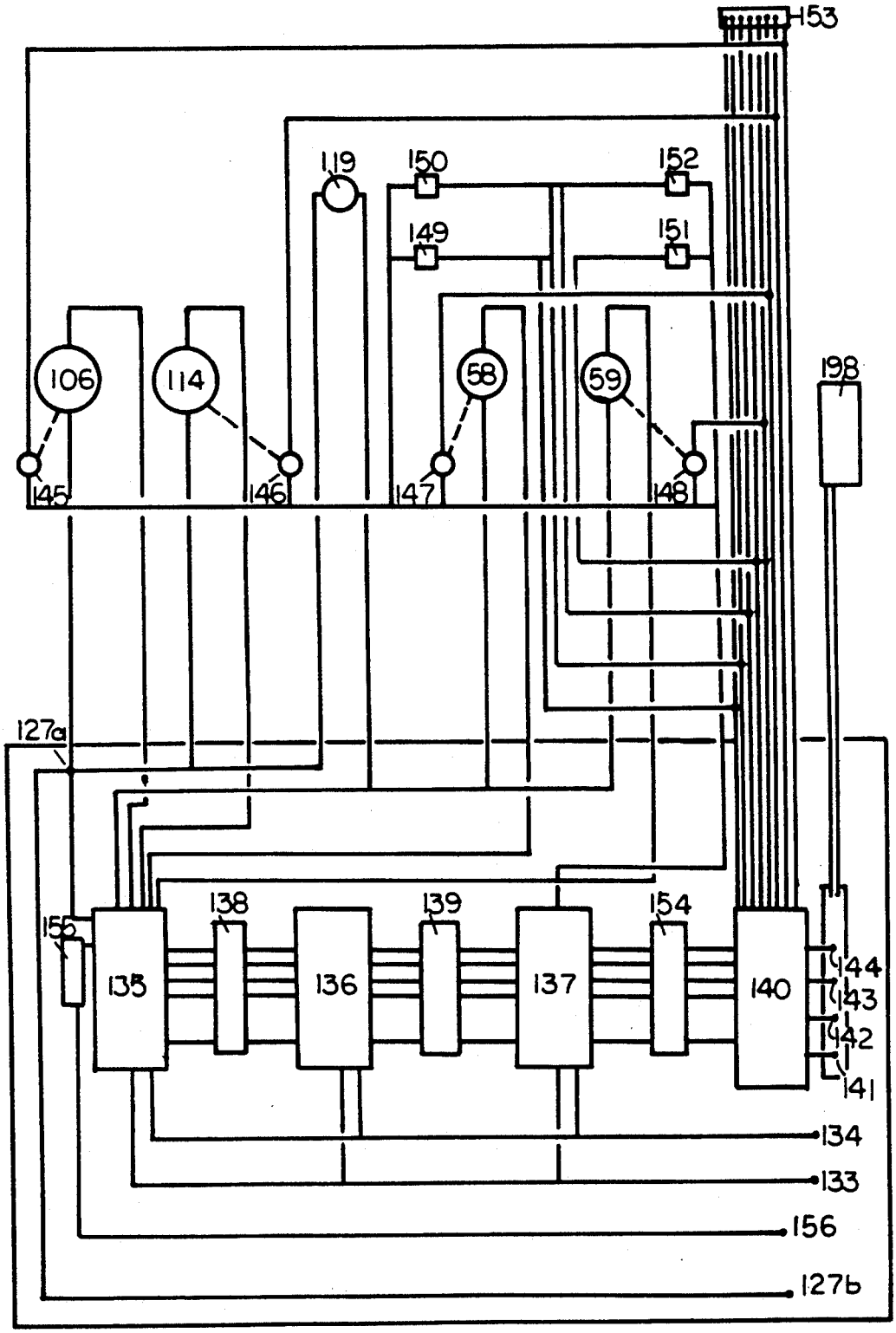
FIG. 15—is a diagram of the electrical power system

Electrical power system is connected to an AC line by the terminals 133 and 134, FIG. 15. Block 135 is a power transformer converting a line AC into a DC consumed by the proposed machine. Block 136 is a filament transformer. Block 137 represents a control transformer. Blocks 138 and 139 illustrate the appropriate inductive connections between blocks 135 and 136, and between blocks 136 and 137 correspondingly. The more detailed diagrams for the above described block schematics are provided in Engineering Handbooks.

Each block from 135 through 139 is deemed to be divided into four parts, and block 135 as a final one has an independently controlled output to four DC motors 58, 59, 106 and 114, all are used to drive outer and inner support roll assemblies, and input and output assemblies correspondingly.

Block 140 is an DC reference voltage generator, independenty controlled by 8 feedback voltage channels, and/or by four channels of command voltages to control the speed of electrical motors 58, 59, 106 and 114 by signals coming through terminals 141, 142, 143 and 144. Current speed of each motor is monitored by pilot generator voltages at sensors 145, 146, 147 and 148, utilizing the motor armature current as a sensored character.

Sensors 149 and 150 monitor the processed material convolutions position along inner support roll length. They sensor the average volt distribution signals from two sets of stands of inner support rolls: from the inward located stands, and from the outward located stands. Sensors 151 and 152 monitor the same kind of signals regarding outer support roll assemblies. All sensored voltages go in two directions: 1) to a terminal clamp 153 to be connected by a cable with a set of indicators on control panel; 2) to the DC reference block 140. A set of reference signals from block 140 feeds into block 154 for a comparative calculation of control voltages needed for increased or decreased motor speeds, in order to keep feedback signals at the level necessary for good spiral spacing and the most efficient energy usage.

This system represents four channelled electronic control of the DC motor speeds with both automatic and a manual operations.

An electromotor 119 drives the hydraulic pump, and it must be connected to the block 135 by a terminal 127.

Box 155 represents a polarity switch, working simutaneously for all four DC motor 58, 59, 106 and 114, to allow a reverse action with the same range of speed. The box is controlled from a terminal 156.

Figure 14:
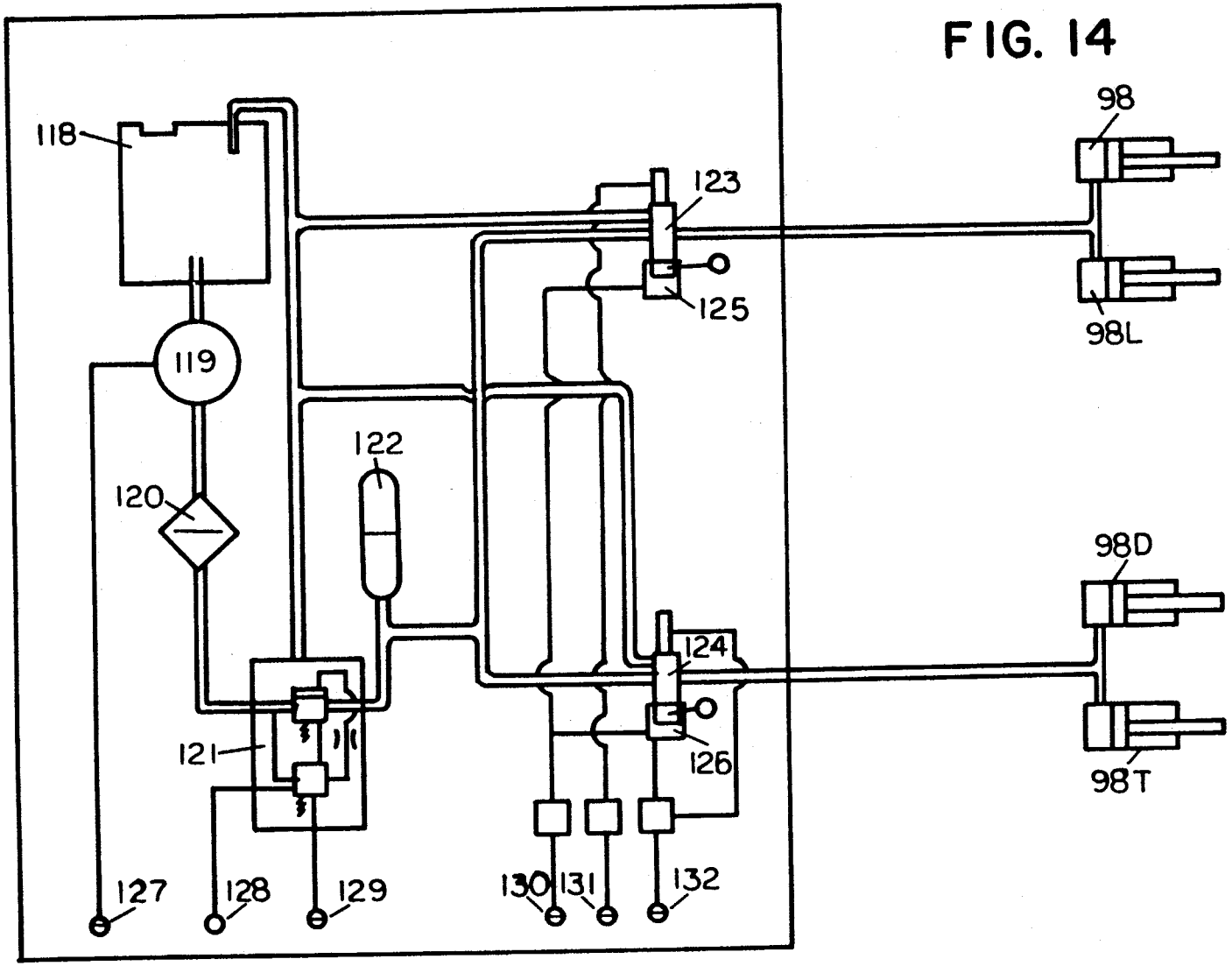
FIG. 14—shows a diagram of the hydraulic to engage a controlled pressure on sliding idling rolls of input and output pinch roll assemblies.

Control panel has a line of indicators for visual monitoring of current flow values in the controlled electrical lines:

157—for a sensor 149 (See FIG. 16 and FIG. 15);
158—for a sensor 150;
159—for a sensor 151;
160—for a sensor 152;
161—for a sensor 148 of the speed of DC motor 59;
162—for a sensor 147 of the speed of DC motor 58;
163—for a sensor 146 of the speed of DC motor 114;
163—for a sensor 145 of the speed of DC motor 106;
165—for a terminal 128 on FIG. 14—a pressure sensor;
166—a signal light from terminal 130 on FIG. 14 to indicated "ON" of electrical controls for hydraulic valves 123 and 124;
167—a signal light from a terminal 127*b* on FIG. 1 15 to indicate a "POWER OFF" condition when the motor 119 is also engaged.

The push botton knobs 168*a* and 168*b* serve to give "ON" or "OFF" condition on the AC line current at terminals 133 and 134 on FIG. 15.

The push button knobs 169*a* and 169*b* serve to give "ON" or "OFF" condition for an electrical control line of the hydraulic valves 123 and 124 on FIG. 14. At "ON" position four push button knobs 172*a*, 172*b*, 174*a*, and 174*b* are engaged to control the pinch rolls in "CLOSED" or "OPEN" position, and the signal light 166 illuminates. In the "OFF" position the push button 169b is pressed in, so only the manual control of hydraulic cylinders 98, 98L, 98D, and 98T by the valves 123 and 124 is applied (See FIG. 14).

A turning knob 170 controls the pressure in the hydraulic system by the pressure valve 121 shown on FIG. 14.

A turning knob 171 provides a manual control of the speed of DC motor 106 driving input pinch roll.

A push botton 172a serves to close the input pinch roll, and a push button 172b serves to open it.

A turning knob 173 provides a manual control of the speed of DC motor 114 driving output pinch roll.

A push button 174a serves to close the output pinch roll, and a push button 174b serves to open it. A turning knob 175 provides a manual control of the DC motor 58 speed driving inner support rolls.

A turning knob 176 provides a manual control of the speed of DC motor 59 driving outer support rolls.

A two-position switch 177 provides forward or reverse direction of motion for all four power drive motors 58, 59, 106 and 114. The right position serves to engage a forward motion, and the left position serves to engage a reverse motion. This switch is connected to the terminal 156 on FIG. 15.

A two-position switch 178 provides engagement of manual controls at the right position, or an automatic control in the left position. In the left position a signal light 179 indicates when the material ends-joining equipment is disengaged, that the input part of the production line is ready to operate. A signal light 180 indicates when the mill process line is ready, and/or is in operation. A signal light 181 indicates, when the material end-joining equipment is engaged, so that the input part of the production line must stop. A signal light 182 indicates when the mill process line is stopped.

183 shows position of a chronograph for current operational time.

184 shows position of a chronograph for cumulative time of working operation.

185 show position of an indicator of the ongoing electrical power consumption.

186 shows position of an indicator for cumulative data on electricity consumption during the time shown on indicator 184.

187a and 187b are timers for a delay before switching "ON" or "OFF" current, having a line voltage final value previously adjusted manually by the turning knob 176, in condition the automatic control is engaged. These timers control "ON" and "OFF" signals for outer support roll DC motor 59. The signals "ON" and "OFF" are coming from the mill process line only.

188a and 188b are two timers for a delay before switching "ON" or "OFF" current, having a line voltage final value being previously adjusted manually by the turning knob 175. The said timers control "ON" and "OFF" signals for inner support roll DC motor 58.

The signals "ON" or "OFF" are coming from both sides: the mill process line, and the material ends-joining equipment. In each case the delay may have a different value. In order to accommodate this condition, each timer 188a and 188b has two separate and independently working parts 188aL, 188aR, 188bL, and 188bR. The timers marked "L" are installed in the signal line from the material ends-joining equipment. The timers marked "R" are installed in the signal line from the mill process line.

189a and 189b are two timers for a delay before switching "ON" the current having a line voltage final value being previously adjusted manually by the turning knob 173, when the automatic control is engaged. These timers control "ON" and "OFF" signals for output pinch roll DC motor 114. The signals "ON" and "OFF" are coming from the mill process line only.

190a and 190b are two timers for a delay before switching "ON" and "OFF" current, having a line voltage final value being previously adjusted manually by the turning knob 171, in condition when the automatic control is engaged. These timers control "ON" and "OFF" signals for input pinch roll DC motor 106. The signals "ON" and "OFF" are from both sides: the mill process line, the material ends-joining equipment. In each case the delay may have a different value. In order to accomodate this conditions, each timer 190a and 190b has two separate and independently working parts 190aL, 190aR, 190bL, and 190bR. The timers marked "L" are installed in the signal line from the material ends joining equipment. The timers marked "R" are installed in the signal line from the mill process line.

191 shows the position of a push button to turn on a memory device to read into the memory all controlled characters shown on indicators of the control panel.

192 shows the position of a push button to turn on a memory device to read from the memory all controlled characters wiring them directly into reference box 140 (FIG. 15).

193 shows the position of a push button to clear data kept in the memory device.

194 shows the position of a push button to engage an optional printer for the data recorded in the memory device.

195a shows the position of a coding device to input addresses into memory storage regarding specific roll materials and the working conditions on a process line, for which the accumulator controlled characters are recorded into, or are read from, the memory.

195b shows the position on an "ON" and "OFF" memory push button.

196 is a cable connector with a material strip ends-joining equipment signals device, generating "ON" and "OFF" signals into the automatically controlled lines of the accumulator's control panel.

197 is a cable connector with a mill process line signals device, generating "ON" and "OFF" signals into the automatically controlled lines of the accumulator's control panel.

Figure 17:
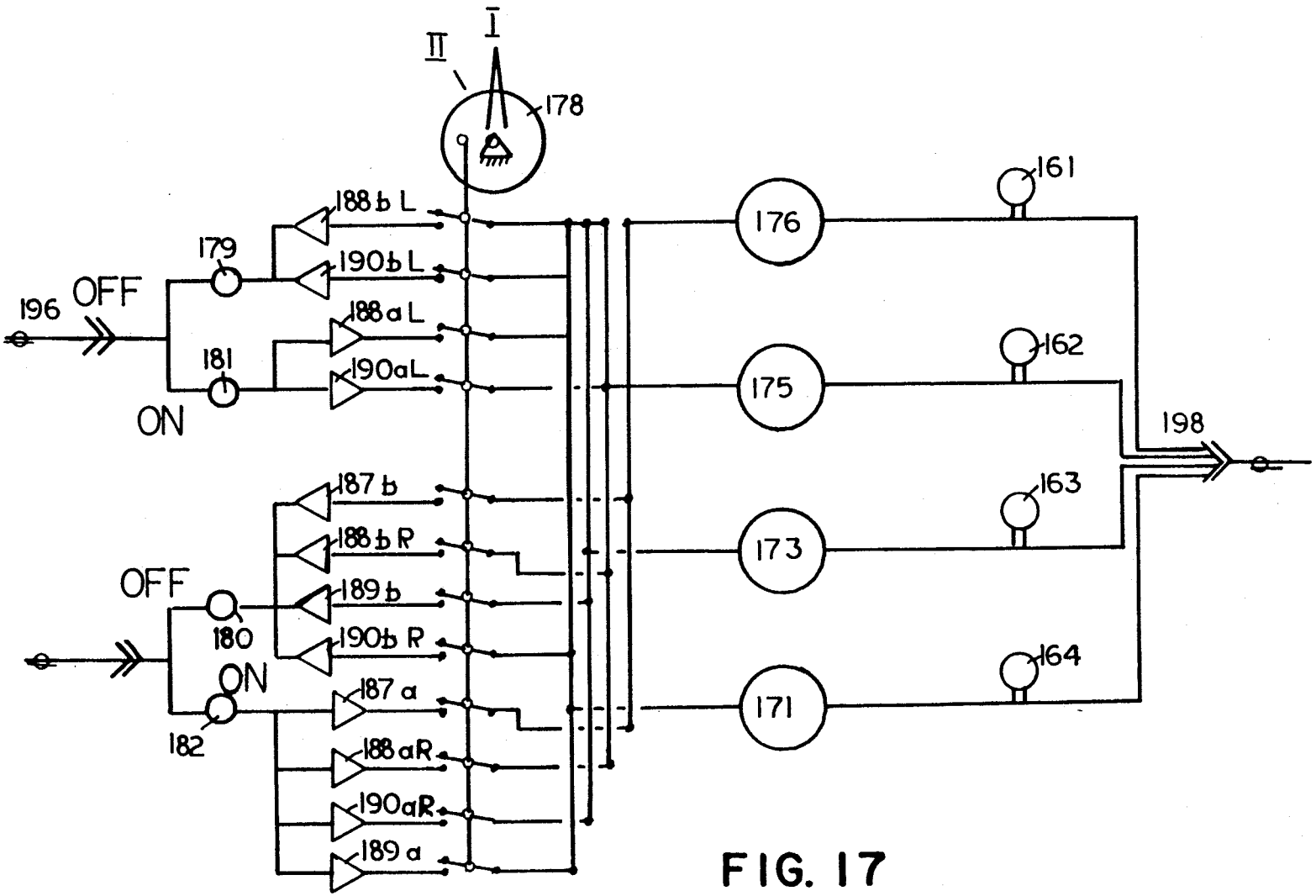
FIG. 17—shows an electronic switchboard diagram for the automatic and manual control engagement of the timers and power motor control knobs on the control panel shown on FIG. 16.

198 on FIG. 17 shows a cable connector from control panel to terminals 141, 142, 143 and 144 on FIG. 15. All interfaces of the two-position switch 178 are shown here, starting with the cable connectors 196 and 197.

The other embodiments as specified in the summary are thought possible.

OPERATION OF THE MACHINE IN PREFERRED EMBODIMENT

Figure 18A:
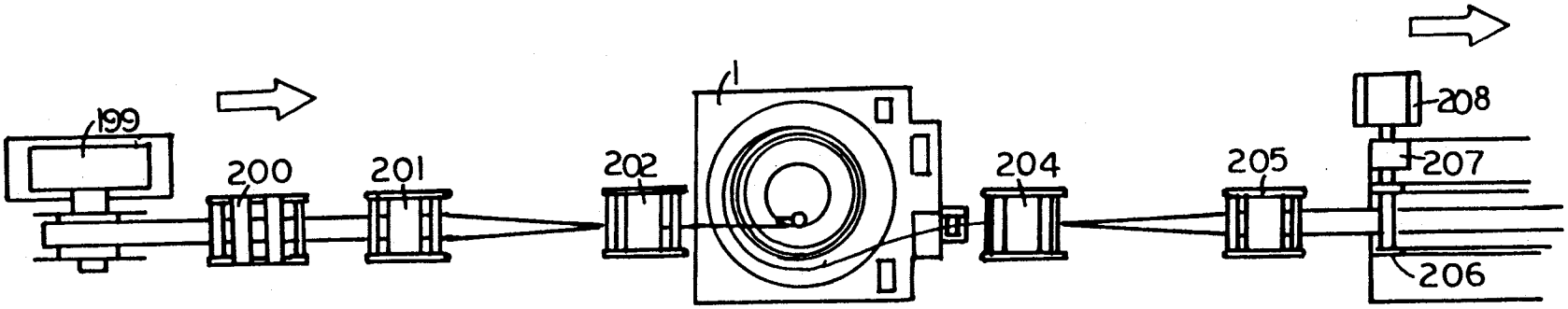
FIGS. 18*a* and 18*b* are top and front views, respectively of a typical rolled material process line utilizing the proposed automatic rolled convolution accumulator.
Figure 18B:
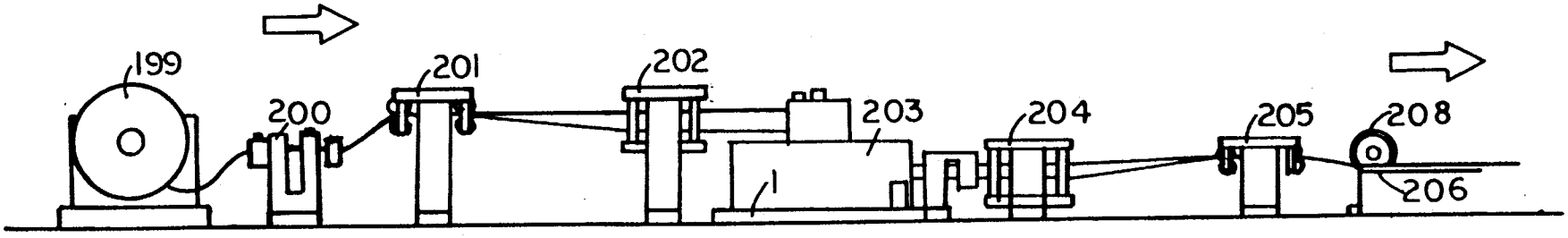

Installation of the invented machine into a material process production line is shown of FIG. 18. Here, 199 is an uncoiler, 200 is a share-welder (or other strip ends-joining device), 201 is the first twisting stand, 202 is the second twisting stand, 203 is the accumulator having preferred embodiment as disclosed above, 204 is the third twisting stand, 205 is the fourth twisting stand, 206 is a mill process line pinch roll, 207 is a mill pinch roll reducer, 207 is mill pinch roll electrical motor.

Figure 16:
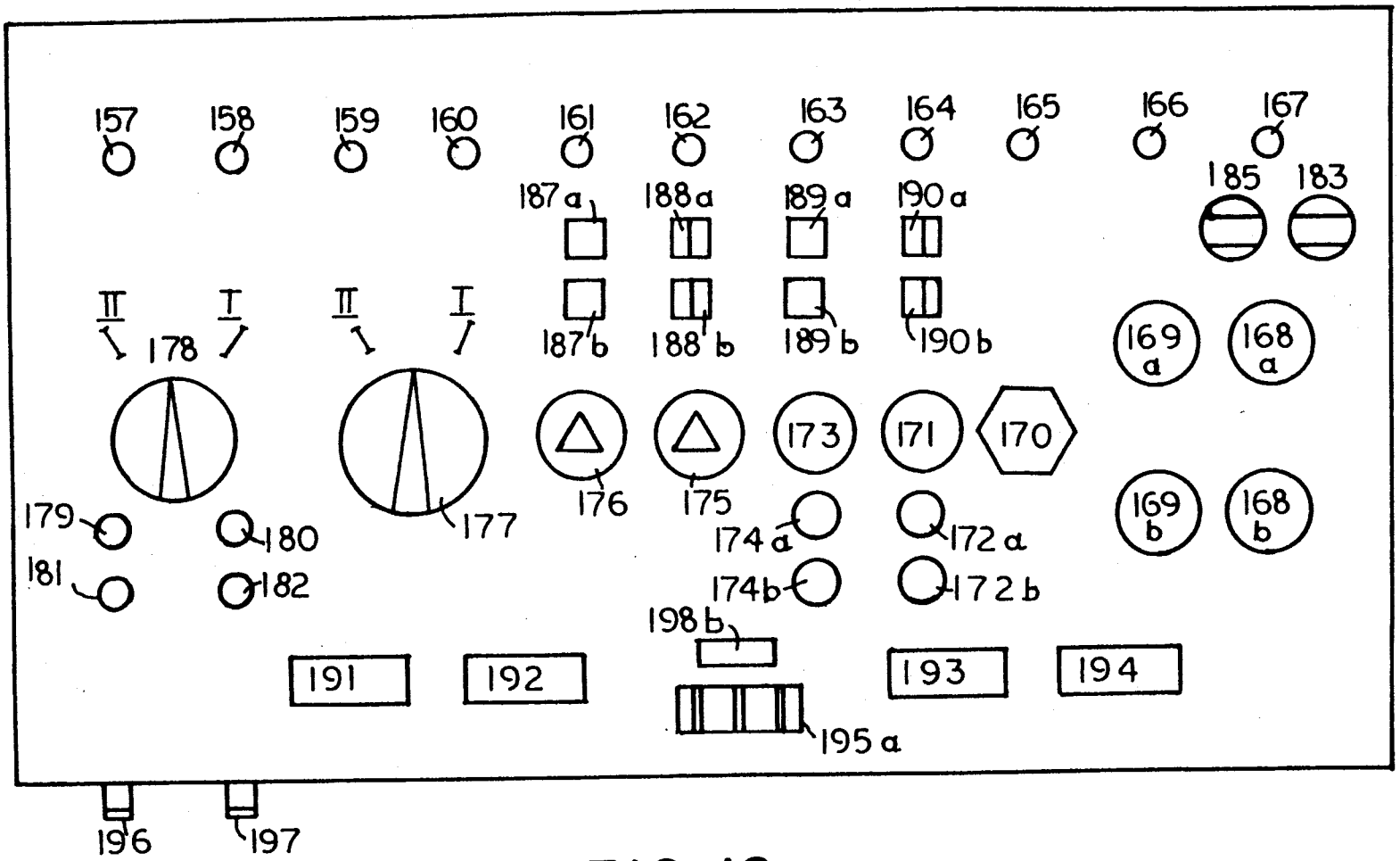
FIG. 16—is a layout of the machine control panel

Item 200 is equipped with a signal device generating "ON" and "OFF" conditions transmitted by a cable into terminal 196 on FIGS. 17 and 16. One of the items 206, 207, or 208 is equipped with a signal device, generating "ON" and "OFF" conditions to be transferred into terminal 197 on FIGS. 17 and 16.

This general layout thought with many variations. A straight-in-line layout shown on the top view may be easily changed to meet any customer requirements, and either input or output strip flows going between items 199, 200, 201, 202 and 203, or between items 203, 204, 205 and 206 may be turned around the machine vertical center line, being directionally relocated under any angle up to 180°. The cross-section view after said the relocation will be the same as the front view shown on FIG. 18, unless the strip flow is changed for the opposite direction inside the accumulator.

For preliminary setting push button 168*a*, 169*b*, 172*b*, 174*b* are pressed in, 195—"OFF". 170 is turned right up to normal pressure on indicator 165. Turning knobs 171, 173, 175, and 176—turned left up counterclockwise to a "ZERO" position. Switch 177 turned right clockwise for "FORWARD". Switch 178 turned left for manual control.

Threading includes a manual procedure to move the front edge of the material strip through items 200 and 201 on FIG. 18, then to twist the front edge in a vertical direction moving it through item 202 on FIG. 18, and through item 9 on FIGS. 1 and 2—input pinch roll.

The outer diameter circle of the machine, including the path way to outer pinch roll, should be closed by screens. The push button 172*a* engages pressure on the material strip. Turning knobs 171, 175 and 176 are turned right for very slow motion. The front edge is threaded between rolls 50*a* and 50*b* (See FIG. 7), down to rolls 51 until the button edge reaches inner support roll. The motion of the front end should continue around vertical center line of the machine until it is filled-in as shown in sectors VII-VIII-IX on FIG. 1. Next the path way to the output pinch roll must be opened, the front end is threaded into the output pinch roll, then into item 204 on FIG. 18; it is then twisted in horizontal direction, threaded through items 205 and 206. Turning knobs 171, 175 and 176 are turned "OFF", push button 174*a* is pressed in, thus closing the output pinch roll. The machine is ready to operate.

If the next kind of rolled strip is not available for welding as a tail, any other surrogate piece of strip may be used in order to save the manual threading efforts when the stored strip going to be used up to the last piece in the mill process line.

If the amount of material spirals inside the accumulator needs to be changed, one of the strip's free ends should go inside the accumulator, and the continuous part of the strip should be set to go into the inner zone (in order to add), or out of the inner zone (in order to subtract) of the accumulated material. The free end should make as many turns around the outer diameter circle, as may be needed to the thought change. Then the free end must be rethreaded through a pinch roll and through following twisting stands, utilizing a forward, or a reverse motion, depending of the direction the free end of the strip being threaded. The turning knob 179 is applied to change (or to check) the direction of the DC motor motion during material and rethreading.

Double synchronized cycle with manual control is engaged by an operator. By visual signals from input and from output sides of the manufacturing line, the operator turns on in the right direction (C.W.) the knobs 171, 173, 175 and 176, shown on FIG. 16. The speed of input pinch roll and the speed of output roll equals and synchronizes with the output speed of an uncoiler 199 (FIG. 18), and with the input speed of a mill pinch roll 206 (FIG. 18). Turning knobs 176 and 175 (FIG. 16) are used until a satisfactory spacing with minimum consumption of energy (shown on indicator 185) is reached. As soon as this result is reached, the material code may be set at the device 195, and all the data shown on indicators 157 through 167 may be recorded into the magnetic memory by pushing down 195*b* and 191, and/or into paper printout by pushing down item 194. This operation of the proposed machine should continue until a signal to change the cycle or to stop the machine is sent either from input or from output of the manufacturing line.

Discharge cycle with manual control is engaged by an operator. By a signal from the input side of the manufacturing line when the input material flow is stopped for an end-joining (welding) operation, the operator turns knobs 171 and 175, FIG. 16, C.C.W. until two motors 58 and 106 (FIG. 15) are stopped. The input pinch roll and the inner support roll are now on hold, while two other DC motors 59 and 114 drive the outer support rolls and the output pinch roll with the same speed as at the double synchronized cycle. Thus, the same output flow of rolled material goes into the mill process line facilitating continuous operation. As soon as the length of the strip equals $L=3{,}1415\times D$, (where D represents diameter of the last spiral) passes the output pinch roll, the next outer spiral expands and takes the place of the exhausted spiral. At the same time, the expanded spiral accomplishes one whole revolution around the machine vertical center line. At the same time, all the inward located spirals expandes on an increment of one spiral space in radial direction, except the first spiral counting from the machine vertical center line. The first spiral do not expand, it shrinks. At the same time almost all the inward located spirals, but the contracted ones, completes the whole revolution around the machine vertical center line. At the same time, the contracted spiral decreases its diameter without rotating motion until it reaches the lower inner vertical rolls 51, FIG. 7. This process continue with some build-up of contracted spirals, and with exhaust of rolled material through the output pinch roll. This process may be interrupted only by a control signal, by machine malfunction, or by material disruption.

To prevent any malfunctions, some specific amount of spirals is left on top of outer support rolls up to the moment the discharge cycle is stopped, or otherwise interrupted. This amount could be measured by indicator 161, and confirmed by the indicators 163 and 185 on FIG. 16 at the time as increased voltages indicates an influence of the drag from held spiral on the set of rotating spirals. It may be that one-third of the length of the material rotated by the accumulator during the double synchronized cycle should be left on top of outer support rolls at the moment the discharge cycle is stopped. The other one-third length should be held in the form of a set of contracted convolutions located around inner vertical rolls, shown in sectors IX-X and X-XI on FIG. 1. Thus, about one-third of the spirals length inside the accumulator may be used to insure the continuous operation of the mill process line. The productive length of the material spirals may vary to great tolerances. It should be established by engineering calculations, and then verified during trails.

As soon as the final acceptable amount of spirals on top of outer support rolls is established, it is recorded into the memory, and an emergency signal is set in correspondence with the data shown on indicators 157, 158, 159, 160, 161, 163, and 185 (FIG. 16). The electrical motors 59 and 114 (FIG. 15), and electrical motor 208 (FIG. 18) are stopped either manually, or automatically as soon as the emergency data are reached by sensor indications.

It is assumed that the time of a discharge operation, before the emergency stop is applied, exceeds the time needed for a metal ens-joining operation. As soon as the strip joining operation is finished, a signal is given to the machine operator to interrupt the discharge cycle, and to go to the next cycle of operation.

Material charge cycle with manual control starts by the signal that the material ends-joining operation is complete. The machine operator turns the knobs 171 and 175, FIG. 16 engaging the DC motor 58 and 196. The voltage readings on indicators 164 and 162 are increased until the set of contracted spirals is accelerated up to a rotating speed, high enough to generate an expansion motion of the most distant members of the set, thus forcing them one by one to go from the inner side, and to join the set of spirals rotated on top of outer support rolls. The speed of the motor 106 is carefully controlled to allow the set of contracted spiral to take the acceleration from the driving torques of inner support rolls, with no loops to be created on downward helix between the set of inner vertical rolls shown on FIG. 7.

Under these conditions, the number of spirals in the outer set is built up at the expense of the number of spirals in the inner set. A possible distributions of the spirals inside the accumulator during the material charge cycle is shown on sectors XI–XII, XII–I of FIG. 1.

The speeds of motors 58 and 106 is set high enough to provide expansion motion of the contracted spirals at a rate sufficient to complete the expansion before the next tailend material strip needs joining operation. Before this need arises, all the accumulator's spirals are to be expanded as shown on sectors VII–VIII and VII–IX of FIG. 1. At that time, the operator interrupts the material charge cycle, and sets the motors 58 and 106 for the speed chosen for the double synchronized cycle. Now, the knobs 171 and 175 are turned in the positions given on the indicators 164 and 162 for the reading, previously established for double synchronized cycle. The double synchronized cycle of operation is discribed above.

Three cycle automated operation starts when the strip and all control knobs on the control panel are ready for a double synchronized cycle. The operator sets the timers: 187*a*, 187*b*, 188*a*L, 188*b*L, 188*a*R, 188*b*R, 189*a*, 189*b*, 190*a*L, 190*b*L, 190*a*R, and 190*b*R according to the delays in voltages motions, chosen during manual operations of corresponding DC motor channels. The push button 195*a* is put "ON". A proper code numbers for rolled material and working conditions to be used are set on the dials 195. The push button 192 is pressed for reading performance data from the memory, (assuming the needed data are in the memory). The switch 178 is turned C.C.W. to engage automated lines of control. All twelve contacts shown under the switch 178 are to be closed, as one can see from schematic on FIG. 17.

For the double synchronized cycle both cables 196 and 197 send the "ON" signals, therefore lights 181 and 182 illuminate, and the timers 188*a*L, 190*a*L, 187*a*, 188*a*R, 190*a*R, and 189*a* feed the gradually increased voltages on controls 176, 175, 173, and 171 having maximum settings taken from memory. The control voltages go through the cable 198 for terminals 141, 142, 143, and 144 on FIG. 15. Four DC motors 59, 58, 106, and 114 accelerate to the selected speed, and maintain it, thus facilitating the double synchronized cycle of operation. Eight sensors monitor the prescribed speeds and the appropriate spacing between the strip spirals. The terminal clamp 153 provides a feedback reading for the indicators 157, 158, 159, 160, 162, 163, and 164 (FIG. 16). The indicators 161, 162, 163, and 164 provide an easy way to correct the automated operation by manual override. To institute manual override, switch 178 should be turned to right (C.C.W.), the turning knobs 171, 173, 175, and 176 are reset as desired, and the new set of data should be read into the memory by pressing push bottom 191. Then the prerecorded data are read back from memory into the reference box 140 on FIG. 15, and the switch 178 (FIG. 15 and 16) is turned left for implementation of automated operation at new conditions.

At the time of the material ends-joining operation, the cable 196 sends the "OFF" signal, while the cable 197 keeps the "ON" signal. The lights 179, and 182 illuminate (FIG. 17). Two DC motors 59, and 114 are "ON" through 190*a*R and 187*a* timers. The signals coming through timers 188*a*R and 189*a* are neutralized by the signals coming from timers 188*b*L and 190*b*L, thus control settings 171 and 175 is gradually going down at the speeds prescribed by timers 188*b*L and 190*b*L, until two other DC motors 58 and 106 stop. Two indicators 162 and 164 show "ZERO". Here, a discharge cycle take place with the mechanical performance previously chosen by manual control, and recorded into the memory device.

As soon as the strip ends-joining operation is completed, the "ON" status is set on the cable 196, the light 179 is set "OFF", and the light 181 illuminates. Here again, the conditions allow to all four DC motors 58, 59, 106, and 114 (FIG. 15) to work with the speeds utilized for the double synchronized operation. However, now the four sensors 149, 150, 151, and 152 reflect that the spirals inside the machine are distributed as shown on sectors IX–X and X–XI of FIG. 1. This information goes into the reference box 140, which then generates in the box 154 (FIG. 15) the control voltages for running the DC motors 58 and 106 at the speeds, manually chosen for the material charge cycle. The material charge cycle continue until the four sensors 149, 150, 151, and 152 reflect that the spirals inside the machine are distributed as shown in sectors VII–VIII and VIII–IX of FIG. 1.

As soon as this moment is reached, the reference box 140 through box 154 generates the control voltages to run DC motors 58 and 106 with the speeds, previously chosen manually for the double synchronized cycle of operation.

The double synchronized cycle of operation can be interrupted once more by the "OFF" signal from the cable 196, generating again the discharge cycle, thus closing the three cycles loop of the described automated operations. It shows that the machine can work without any attention, or interference from an operator, providing it has been turned up for the specific rolled material, and for specific working conditions.

The memory device of the machine furnishes the tool to easily create a library of performance characteristics for each type of strip and working conditions on a process line, thereby saving the operator efforts and time on tune-ups.

An automatic stop of the machine is initiated by two channels:

a) By "OFF" signal sent from the mill process line through the cable 197. This action turns-off light 182, and switches on light 180, FIG. 17. The signal goes through the timers 187*b*, 188*b*R, 189*b*, and 190*b*R initiating them all for DC motor channels 171, 173, 175, and 176, gradually lessening the controll voltages until all four DC motors 58, 59, 106 and 114 stop.

b) By "EMERGENCY STOP", i.e. a signal generated by the set of sensors, previously described at the discharge cycle, and used to prevent any damages from abnormally high drag. Thus, the same set of sensors 157, 158, 159, 160, 161, 163 and 185 on FIG. 16 is used through the reference box 140 to stop automatically, all four DC motors in any of three operational cycles, thus insuring a complete safety in utilization of the proposed machine.

The other embodiments as specified in the summary are thought possible with reasonable adoptation of the described operations.

I claim:

1. A strip convolution accumulator for continuous discharge of strip material regardless of interruptions in input to the accumulator, the strip being wound into a coil having an innermost convolution and an outermost convolution, said strip material being fed into the accumulator at the innermost convolution and withdrawn from the outermost convolution, said accumulator comprising a horizontally oriented base; a first set of vertically oriented equally circumferentially spaced rollers radially outside of and engaging the outermost convolution; a first set of horizontally oriented support rollers equally radially spaced and extending radially beyond the outermost convolution; a second set of vertically oriented equally circumferentially spaced rollers extending radially inwardly beyond the innermost convolution; a second set of horizontally oriented equally radially spaced support rollers extending radially inwardly beyond the innermost convolution, first and second electric motors with transmissions to said first and second sets of horizontally oriented support rollers, respectively; an input pinch roller assembly hydraulically actuated into contact with the strip material to feed the strip material to the innermost convolution, said input pinch roller assembly having a third motor, an output pinch roller assembly hydraulically actuated into contact with said strip material to feed said strip from said outermost convolution, said output pinch roller assembly having a fourth motor; and an electrical power system to provide four independent drives for said motors.

* * * * *